United States Patent [19]

Ito et al.

[11] Patent Number: 5,023,516

[45] Date of Patent: Jun. 11, 1991

[54] DISCHARGE LAMP OPERATION APPARATUS

[75] Inventors: Kazuhiko Ito, Hirakata; Kouji Miyazaki, Yawata; Masakatsu Kichibayashi, Sakaide; Shigeru Horii, Takatsuki; Masataka Ozawa, Takarazuka, all of Japan

[73] Assignee: Matsushita Electric Industrial Co., Ltd., Osaka, Japan

[21] Appl. No.: 346,940

[22] Filed: May 3, 1989

[30] Foreign Application Priority Data

May 10, 1988 [JP] Japan ..... 63-114455
Jun. 6, 1988 [JP] Japan ..... 63-138813
Aug. 1, 1988 [JP] Japan ..... 63-192528

[51] Int. Cl.[5] ..... H05B 39/00

[52] U.S. Cl. ..... 315/101; 315/219; 315/224; 315/307; 315/DIG. 7

[58] Field of Search ..... 315/94, 101, 219, 224, 315/DIG. 2, DIG. 7, 307, 291

[56] References Cited

U.S. PATENT DOCUMENTS 4,647,817 3/1987 Fähnrich et al. ..... 315/101 X

*Primary Examiner*—Robert J. Pascal

*Attorney, Agent, or Firm*—Wenderoth, Lind & Ponack

[57] ABSTRACT

A discharge lamp apparatus is capable of securely detecting the decrease of emission in the terminal stage of the life of a discharge lamp by connecting a voltage detecting circuit to the discharge lamp, and a discharge lamp apparatus for securely starting, operating and dimming the discharge lamp, and is also capable of protecting the lamp in the event of abnormality; the apparatus includes two timer circuits, a reset circuit, a dimmer circuit, an abnormality detecting circuit, and a stopping circuit.

20 Claims, 12 Drawing Sheets

Lamp Voltage
Inductance
Current

Collector Current
of Transistor 6

Output Signal
of Voltage
Detection Circuit

Output Signal
of Control Circuit

Normal Lamp

Abnormal Lamp

DISCHARGE LAMP OPERATION APPARATUS

BACKGROUND OF THE INVENTION

This invention relates to a discharge lamp apparatus for starting and operating the discharge lamp at a high frequency.

This invention also relates to allowed U.S. application Ser. No. 288,133 filed Dec. 22, 1988 entitled "DISCHARGE LAMP OPERATION APPARATUS" (inventor: Masakatsu KICHIBAYASHI et.al.)

Recently, in discharge lamp apparatus, attempts have been made to operate the lamp by means of a high frequency inverter which is a switching circuit composed of semiconductor devices, from the aspects of higher efficiency and smaller size and lighter weight. More lately, in particular, a compact fluorescent lamp has been developed, and a smaller size is demanded in the discharge lamp operation apparatus using a high frequency inverter.

The discharge lamp apparatus prior to this invention was composed, for example, of a circuit as shown in FIG. 1. This circuit was disclosed in Japanese Patent application No. 62-328596.

That is, in FIG. 1, numeral 4 denotes a power source circuit comprising a commercial power source 1, a rectifying bridge 2, and a smoothing capacitor 3, which outputs a D.C. voltage. Numeral 5 denotes a capacitor connected in series to the output of the power source circuit 4, and numeral 6 denotes a transistor connected between the capacitor 5 and the power source circuit 4; a series circuit of fluorescent lamp 7 and inductance 8 is connected in parallel to the capacitor 5, and a series circuit comprising a starting circuit composed of a capacitor 9 and an inductor 10 and a PTC thermistor 21 is connected in parallel the terminal of the fluorescent lamp not connected to the power source circuit 4. The PTC thermistor 21 is connected to the terminal of the lamp not connected to the transistor 6. Numeral 22 denotes a zener diode which is a voltage responsive switching element having one terminal connected to a connecting point A between the PTC thermistor 21 and the capacitor 9, and numeral 23 denotes a short-circuit transistor having a base connected to the diode 21A connected to the other terminal of the zener diode 22, and having a collector connected to a capacitor 13. Numeral 11 denotes a self-oscillation switching circuit composed of the capacitor 5, the transistor 6 and the inductor 8. Numeral 12 denotes a driving inductor having one terminal connected to the base of the transistor 6, and having a series circuit consisting of a secondary winding **8*b* of the inductor 8 and a driving capacitor 13 connected between the other terminal and an emitter of the transistor 6. Numeral 17 denotes a timer circuit composed of voltage dividing resistances 14 and 15 connected to an output terminal of the power source circuit 4 and a capacitor 16 having one terminal connected in the connecting point thereof; numeral 18 denotes a short-circuit transistor having a base connected to the other terminal of the capacitor 16 and having a collector and emitter connected in parallel to the inductor 12; numeral 19 denotes a diode having a cathode connected to the base of the transistor 6 and an anode connected to the emitter of the transistor 6 through a resistance 20**.

The operation of the thus composed conventional circuit is explained below. When the power is turned on, a voltage is generated in the power source circuit 4, and a starting current flows through the resistor 14 of the timer circuit 17, capacitor 16 and the base of transistor 18 to cause transistor 18 to conduct, and at the same time the transistor 6 is turned on through its base current. Initially, the fluorescent lamp 7 is not operating, and the current flows from the power source circuit 4 and runs through the transistor 6 by way of the inductor 8, the filament electrode of fluorescent lamp 7, capacitor 9 and inductor 10. At this time, a positive voltage is generated in the secondary winding **8*b* of the inductor 8, and the base current of the transistor 6 is supplied through the capacitor 13 and inductor 12, so that the ON state of the transistor 6 is maintained. Here, the current flowing in the primary winding 8*a* of the inductor 8 is a resonance current of the capacitor 9 and inductor 8. At this moment, the current flowing due to the positive voltage generated in the secondary winding 8*b* of the inductor 8 is a series resonance current at the characteristic frequency of inductor 12 and capacitor 13, but actually since the transistor 18 is turned on, the current also flows slightly in the reverse direction from the emitter to the collector of the transistor 18, and the state of resonance is weak, and the inductor 12 hardly operates, and therefore, the oscillation period becomes shorter, being closer to the charge and discharge time of the capacitor 13. Accordingly, the capacitor 13 is charged nearly up to the voltage generated by the secondary winding 8*b*, and the base current of the transistor 6 no longer flows, and when the base current of the transistor 6 is slightly pulled in the reverse direction by the effect of the inductor 12, the transistor 6 is about to be turned off, and the voltage generated at the secondary winding 8*b* becomes small, so that the secondary winding 8*b* becomes small, so that the electric charge stored in the capacitor 13 is fed back to be applied in the reverse direction between the base and emitter of the transistor 6, thereby causing the transistor 6 to turn off quickly. When the transistor 6 turns off, the energy stored in the series resonance circuit of capacitor 9 and inductor 8, and the inductor 10 is released to the capacitor 5, fluorescent lamp 7, capacitor 9, inductor 8 and inductor 10, and oscillates to become a preheating current of the fluorescent lamp 7. At this time, the elements are arranged so that the fluorescent lamp 7 may not be started by the voltage generated by the capacitor 9. While the transistor 6 is turned off, the oscillation current flowing in the primary winding 8*a* of the inductor 8 generates a negative voltage at the secondary winding 8*b* of the inductor 8. Here, the transistor 18 is turned on in the forward direction, and the inductor 12 does not operate at all, and therefore, by this voltage, a reverse voltage is applied between the base and emitter of the transistor 6 through the diode 19 and resistor 20 to maintain the OFF state of the transistor 6. When the oscillation current passes over the negative peak, a positive voltage is gradually generated in the secondary winding 8*b* of the inductor 8, and the voltage charged in the reverse direction in the capacitor 13 while the transistor 6 is OFF is applied to the base of the transistor 6 in the forward direction to turn on the transistor 6. At this time, right after turning on, the current of the inductor 8 is still flowing in the reverse direction, and the current flows from the base to the collector through the diode 19 and resistance 20. Gradually the reverse current of the inductor 8 decreases, and a forward current begins to flow into the transistor 6, and thereafter the same operation as mentioned above is repeated. By this oscillation operation, as the time passes, the temperature of the preheat electrode of the fluorescent lamp 7** goes up.

The timer circuit 17 feeds base current to the transistor 18 while charging the capacitor 16 through the resistance 14 after the power source is turned on, and when charged up to the voltage specified by resistances 14 and 15 after a specified time, it is no longer charged, and thereafter the current is shut off, and the current no longer flows in the base of the transistor 18 until the electric charge in the capacitor 16 is discharged through the resistances 14 and 15. Accordingly, when the transistor 18 is turned off after a specified time, a positive voltage is generated by the secondary winding 8*b* of the inductor 8 when the transistor 6 is turned on, and a base current is supplied to the transistor 6 by way of the capacitor 13 and inductor 12. This base current is a resonance current of the capacitor 13 and inductor 12, and near the half period, the base current of the transistor 6 changes from positive to negative, and when the stored charge in the transistor 6 is released, the transistor 6 is turned off. Before starting the fluorescent lamp 7, the inductor 8 and capacitor 9 are in a series resonance state, and the inductors and capacitors are set so that a voltage which is much larger than the operating voltage, and larger than the preheating voltage before operation of timer circuit, and sufficient for starting the fluorescent lamp 7 is generated in the capacitor 9. Accordingly, the fluorescent lamp 7 is started. After starting, the operation of the circuit is almost similar to the operation after the start of the timer circuit 17, but since the impedance of the fluorescent lamp 7 is connected in parallel to the impedance of the capacitor 9 and inductor 10, the current of the capacitor 9 decreases, and a current flows in the fluorescent lamp 7. As a result, the resonance of the inductor 8 and capacitor 9 is almost lost, and a positive or negative voltage according to the difference of the output voltage of the power source circuit 4 and the lamp voltage is generated in the secondary winding 8*b* of the inductor 8, and the transistor 6 is controlled in its on/off operation depending on the characteristic frequency determined by the inductor 8, capacitor 5, fluorescent lamp 7, inductor 12, and capacitor 13. The inductor 10 is for the removal of DC components of the current of the fluorescent lamp 7. A transistor 23 is intended to stop the current for driving the transistor 6 from the driving circuit of the switching circuit 11 by the current flowing into the base thereof.

In the thus composed conventional circuit, when the electrode 7*a* of the fluorescent lamp 7 is emitterless and the electrode 7*b* has an emitter, by turning on the power source 1, the switching circuit 11 begins to oscillate. However, since the electrode 7*a* of the fluorescent lamp 7 is emitterless, the lamp current flows from the electrode 7*a* to the electrode 7*b*, but does not flow in the reverse direction. Accordingly, a large current corresponding to the lamp current flows in the PTC thermistor 21 through the capacitor 9, and the temperature of the PTC thermistor 21 goes up, and when nearing the curie temperature, the resistance increases suddenly. Along with the increase in the resistance value, the resonance voltage of the capacitor 9 and inductor 8 is overlaid on the supply voltage, and the peak voltage becomes high. When the peak voltage of the connecting point A reaches the operating voltage of the zener diode 22, a current flows into the base of the transistor 23 through the zener diode 22 from the connecting point A, and the transistor 23 is operated, and the connecting point B of the capacitor 13 and inductor 12 and the negative voltage side of the power source 4 are short-circuited. In consequence, the supply of base current to the transistor 6 is stopped, and the operation of the switching circuit stops.

On the other hand, when the electrode 7*b* of the fluorescent lamp 7 is emitterless and the electrode 7*a* has an emitter, and when both electrodes 7*a* and 7*b* are emitterless, the operation is as flows. In such cases, current hardly flows from the power source circuit 4 through the lamp directly, and the current directly passes through the PTC thermistor 21 from the power source circuit 4 to change the resistance of the PTC thermistor suddenly, and the operation of the switching circuit 11 is stopped by the transistor 23, while almost no current flows from the power source circuit 4 through the fluorescent lamp 7 and capacitor 9, and the base current of the transistor 6 does not flow due to the inductor 8, thereby stopping the operation of the switching circuit 11.

In such a constitution, however, when the lamp voltage becomes high after, for example, fluctuations of the supply voltage or dimming, the current flowing in the PTC thermistor 21 becomes large, and operation of the lamp may not be maintained although the PTC thermistor 21 is raised in temperature and the lamp is operating normally. Besides, when turning on the power, a large current always flows in the PTC thermistor 21, and the temperature of the PTC thermistor 21 is raised somewhat. Accordingly, when the power on/off operation is repeated, the lamp may not operate due to temperature rise of the PTC thermistor 21.

SUMMARY OF THE INVENTION

It is hence a primary object to present a discharge lamp apparatus completely free from anxieties.

In other words, this invention presents a discharge lamp apparatus capable of detecting the decrease of emission in the terminal stage of the discharge lamp life by connecting a high voltage detecting circuit to the discharge lamp.

It is another object of this invention to present a discharge lamp apparatus comprising two timer circuits, a reset circuit, a dimmer circuit, a failure detection circuit, and a stopping circuit so as to protect the discharge lamp at the time of starting, operating, dimming or abnormality.

According to the present invention as described herein, the following benefits, among others, can be obtained.

(1) The state of the lamp can be detected by a voltage detecting circuit in a simple structure in the event of an abnormality of the discharge lamp or at the terminal end of its life, and the oscillation of the switching circuit can be stopped, and it is possible to start repeatedly, and this discharge lamp apparatus can be used in high temperature environments.

(2) Furthermore, in the event of an abnormality or the end of the life of the discharge lamp, the discharge lamp can be started, operated or dimmed by a dimmer circuit in a simple structure, and the state can be detected if abnormal, and oscillation of the switching circuit can be stopped, and furthermore it is possible to use the lamp repeatedly.

While the novel features of the invention are set forth in the appended claims, the invention, both as to organization and content, will be better understood and appreciated, along with other objects and features thereof, from the following detailed description taken in conjunction with the drawing.

DETAILED DESCRIPTION OF THE INVENTION

Figure 1:
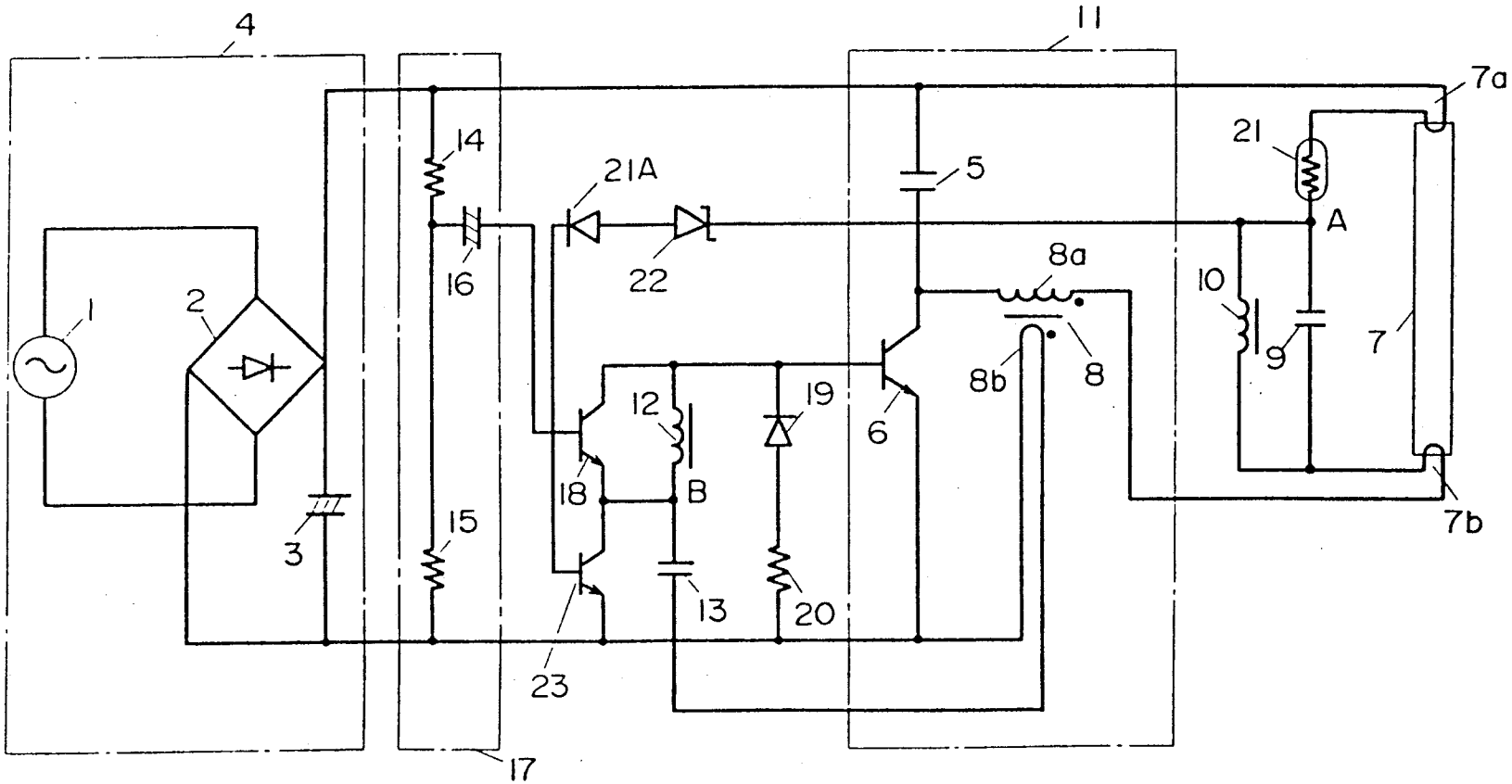
PRIOR ART FIG. 1
FIG. 1 is a circuit diagram of a discharge lamp apparatus developed prior to the present invention.

Referring now to the drawings, a first embodiment of the present invention is described in detail below. FIG. 2 is a circuit diagram showing the first embodiment of a discharge lamp apparatus of the present invention. In FIG. 2, the components from the commercial power source 1 to the resistor 20 are same as those in FIG. 1 in both construction and operation. What are different from the example in FIG. 1 include the following: the series circuit of resistances 31 and 32 and inductor 10 connected in parallel to the discharge lamp 7 of a preheat starting type and connected to the side of the power source 1 not connected to transistor 6, diodes 33 and 34 having their cathodes connected across the series circuit of the resistors 31 and 32, a transistor 35 having an emitter connected to the connecting point of the series circuit of resistors 31 and 32, and having a base connected the anode of the diodes 33 and 34, a voltage detecting circuit 36 composed of the resistors 31 and 32, inductor 10, diodes 33 and 34, and transistor 35, and a thyristor 37 used as a control circuit which is a switch with a control terminal for short-circuiting the base and emitter of the transistor 6 by feeding an output signal from the collector terminal of the transistor 35 as the output of the voltage detecting circuit 36 to the gate.

The operation of the thus composed circuit of this embodiment is explained below. The operation from turning on the power source until the normal operating of the fluorescent lamp 7, in which the transistor 35 and thyristor 37 are OFF, is the same as in the prior art, and is not explained here again, and only the different action is explained below by referring to FIG. 2. That is, FIGS. 3(*a*)-3(*d*) are waveform diagrams of this embodiment. When the electrode 7*a* of the fluorescent lamp 7 is emitterless and the electrode 7*b* has an emitter, by turning on the power source 1, in the same fashion as in the conventional example, the switching circuit 11 begins to oscillate. However, since the electrode 7*a* of the fluorescent lamp 7 is emitterless, when the transistor 6 is ON, the lamp current flows from the electrode 7*a* to the electrode 7*b*, but does not flow reversely when the transistor 6 is OFF. Accordingly, the current due to the energy stored in the capacitor 5 and inductor 8 when the transistor 8 is OFF flows from the inductor 10 to the resistor 31.

Incidentally, at this time, as shown in FIG. 3(*a*), the current flowing in the inductor 10 has a phase delay of nearly 90 degrees with respect to the lamp voltage due to the large inductance component. By this current, a voltage drop is generated in the resistances 31 and 32. The voltage drop generated at this time is high at the inductor 10 side and low at the electrode 7*a* side. Here, by the resistance value of the resistor 31 and the voltage drop generated by the resistance 31 determined by the current flowing in the resistor 31, the diode 33 and transistor 35 are turned on, and an output signal is delivered from the collector terminal of the transistor 35 as shown in FIG. 3(*c*). Accordingly, this current flows into the gate of the thyristor 37, and the thyristor 37 is actuated to short-circuit the base and emitter of the transistor 6. Thus, the supply of base current to the transistor 6 is stopped, and the operation of the switching circuit is stopped. At this time, when the thyristor 37 is once turned on, it is not turned off unless the flowing current becomes lower than the holding current, it keeps the ON state while the collector current is flowing as shown in FIG. 3(*d*).

On the other hand, when the electrode 7*b* of the fluorescent lamp 7 is emitterless, and the electrode 7*a* has an emitter, or when both electrodes 7*a* and 7*b* are emitterless, the operation is as follows. In this case, in the same fashion as in the prior art, the switching circuit 11 begins to oscillate. However, since the electrode 7*b* of the fluorescent lamp 7 is emitterless, when the transistor 6 is turned on, the lamp current does not flow from the electrode 7*a* to electrode 7*b* . Therefore, the electric current flows from the positive terminal of the power source through the resistor 31, inductor 10 and inductor 8 to reach finally the transistor 6. Hence, a voltage drop is generated in the resistor 31 and 32. The voltage drop generated at this time is, meanwhile, low at the inductor 10 side, and high at the electrode 7*a* side. At this time, by the resistance value of the resistor 32 and the voltage drop generated by the resistor 32 determined by the current of the resistor 32, the diode 34 and transistor 35 are turned on, and the signal from the collector terminal of the transistor 35 output is the same as in the emitterless case only for the electrode 7*a* . Accordingly, a current flows in the gate of the thyristor 37, and the thyristor 37 is operated, and the base and emitter of the transistor 6 are short-circuited. As a result, supply of the base current to the transistor 6 is stopped, and the operation of the switching circuit is halted. In this case, once the operation of the switching circuit is stopped, it is not restarted unless the power source 1 is cut off and the timer circuit 17 is reset because starting current does not flow from the timer circuit 17.

By such constitution, by properly setting the resistance values of the resistors 31 and 32, the detection level can be set freely, and hence it is safe because the oscillation of the circuit may be stopped by securely detecting the end of life of the discharge lamp 7 regardless of the magnitude of the lamp voltage during operation. Besides, since temperature elements such as PTC thermistors are not used, the power on/off switching may be effected repeatedly. Besides, without being affected by the ambient temperature, on/off switching can be done repeatedly even where the ambient temperature is high. In addition, since signals with a 90-degree phase delay may be easily produced by the inductor 10, the thyristor 37 can be already turned on when the collector current of the transistor 6 begins to flow as shown in FIG. 3(*b*), and the flow of base current may be prevented if the transistor 6 is about to turn on, so that the oscillation may be stopped. Furthermore, since the inductor 10 is used in the voltage detecting circuit 36, if a large surge voltage should flow in the discharge lamp 7, it is impeded by the inductor 10, and an overvoltage is not applied to the semiconductor elements, and hence the reliability is high and cost is low. Moreover, since most of the voltage is contained in the inductor 10, the resistance loss is small, and the current is abundant, so that a secure detection is realized. In this embodiment, furthermore, since two resistors are used, the single-side emitterless state in two directions may be stably detected by a simple constitution.

Figure 4:
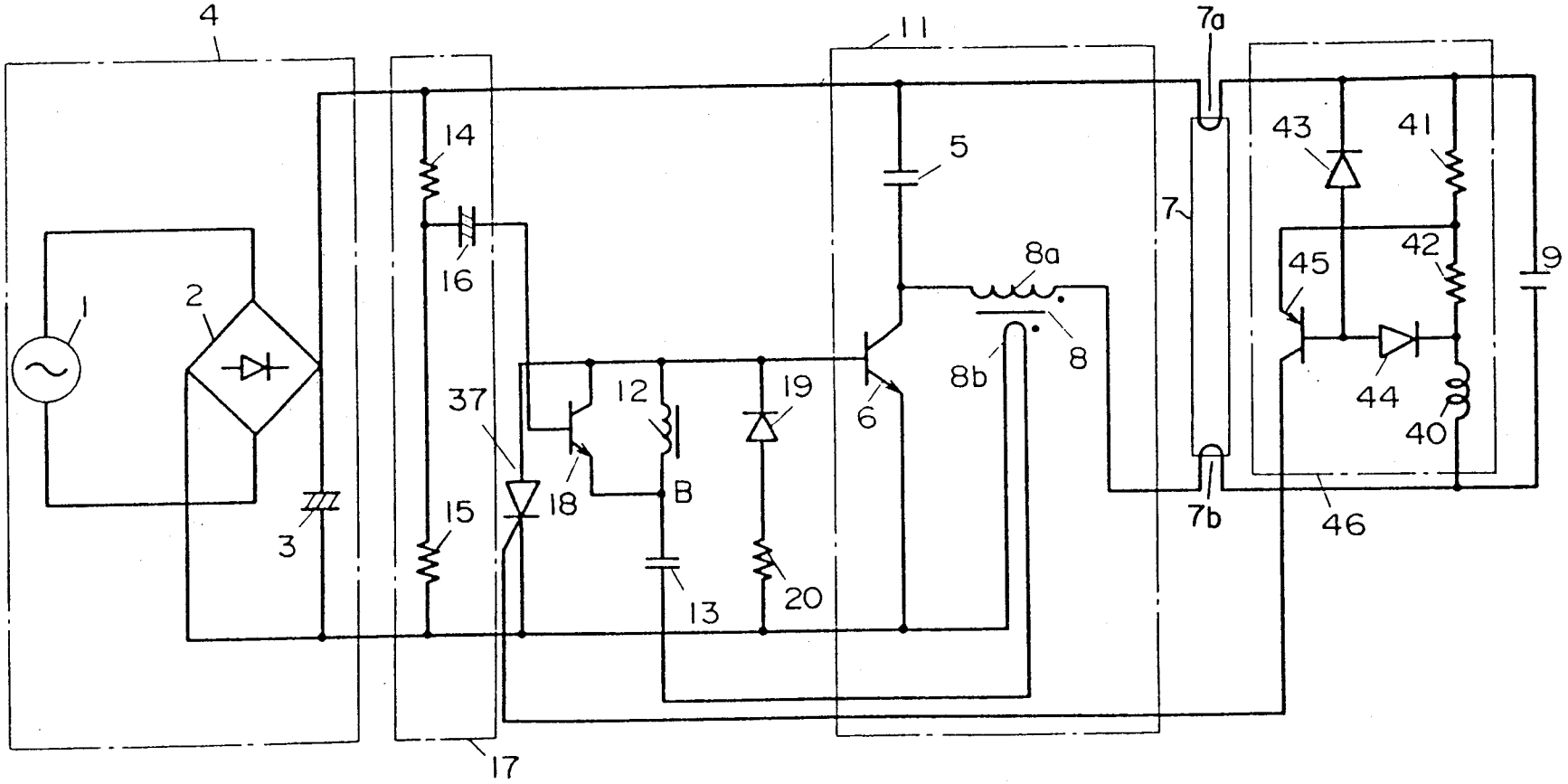
FIGS. 4-7 are circuit diagrams of second-fifth embodiments of a discharge lamp apparatus according to the present invention.

FIG. 4 is a circuit diagram showing a second embodiment of a discharge lamp apparatus of the present invention. In FIG. 4, the components from the commercial power source 1 to the resistor 20 are same as in the first embodiment in both construction and operation. What is different is that the position of connecting the voltage detecting circuit 46 is set at the side of the discharge lamp 7 away from the power source, and the structure, operation and effect are nearly same was in the voltage detecting circuit 36 shown in FIG. 2. That is, resistors 41 and 42, inductor 40, diodes 43 and 44, and transistor 45 are identical in function with resistors 31 and 32, diodes 33 and 34, ad transistor 35 in the first embodiment. The thyristor 37 which is a control circuit is also identical in composition and operation as in the first embodiment.

In such a composition, aside from the same effects as in the first embodiment, that is, detection of the end of life or other abnormal state of the discharge lamp 7 and stopping of oscillation of the switching circuit 11, in this embodiment, since the voltage detecting circuit 46 is disposed at the side of the discharge lamp 7 away from the power source 1, the current flowing in the inductance 10 runs by way of the filaments 7*a* and 7*b* of the discharge lamp 7, and this current contributes to the preheat current of the discharge lamp 7, so that the life of the discharge lamp 7 may be extended, while the discharge lamp 7 may be operated at a low starting voltage.

Figure 5:
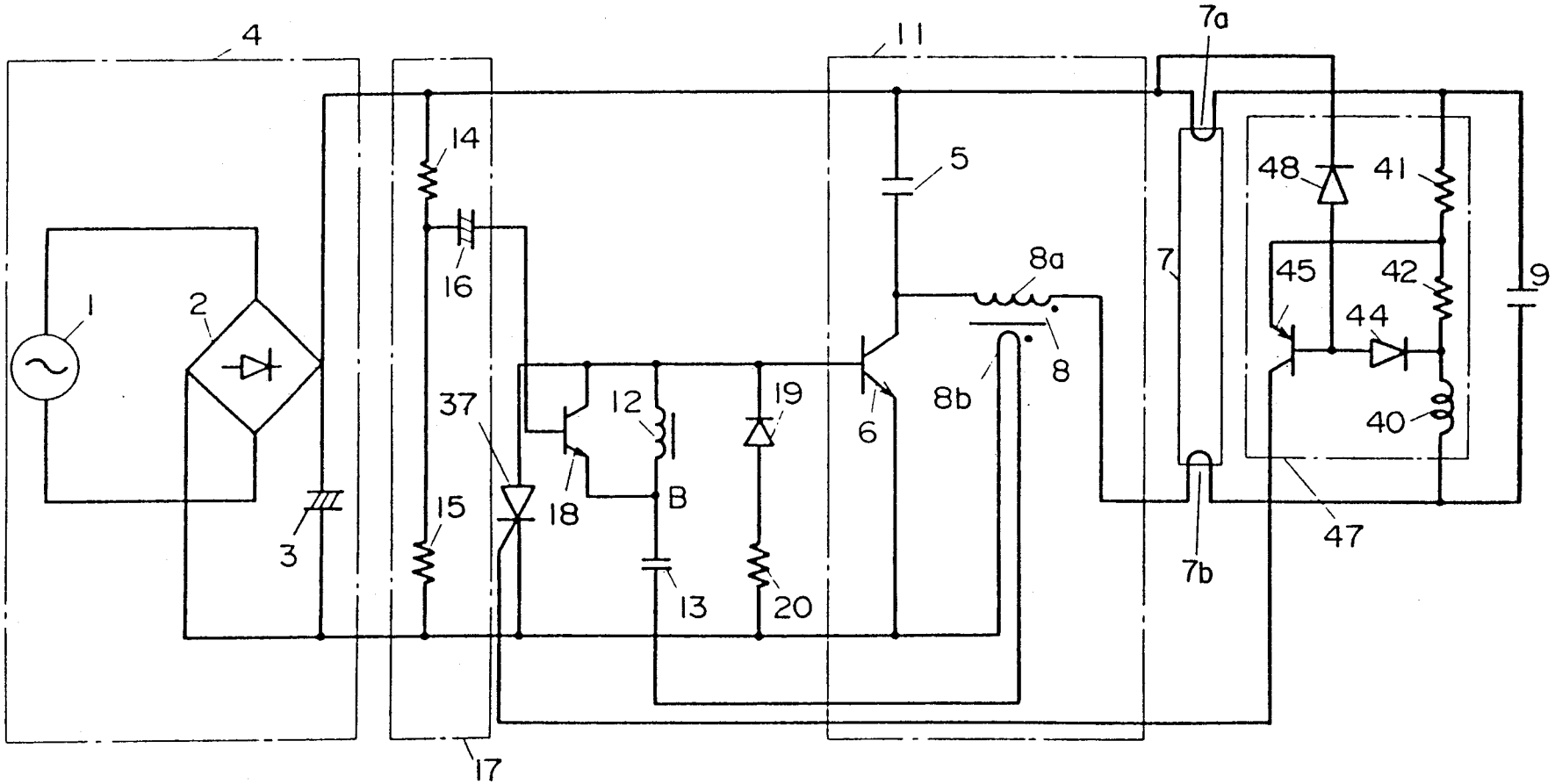

FIG. 5 is a circuit diagram showing a third embodiment of a discharge lamp apparatus of the present invention. In FIG. 5, the components from the commercial power source 1 to the resistor 20, and the control circuit composed of thyristor 37, inductor 40, resistors 41 and 42, diode 44, and transistor 45 are same as those in the second embodiment in both construction and operation. What is different is that the connecting position of the cathode of the diode 48 of the voltage detecting circuit 47 is set at the positive voltage part of the power source side of the discharge lamp 7.

In such a constitution, in addition to the effects of the first and second embodiments, by detecting the voltage at a voltage corresponding to the sum of the voltage drop of the resistor 41 and the voltage drop of the filament electrode 7*a*, the voltage difference between the emitterless state of the lamp and its operating state can be increased, so that the emitterless state may be detected more easily.

Figure 6:
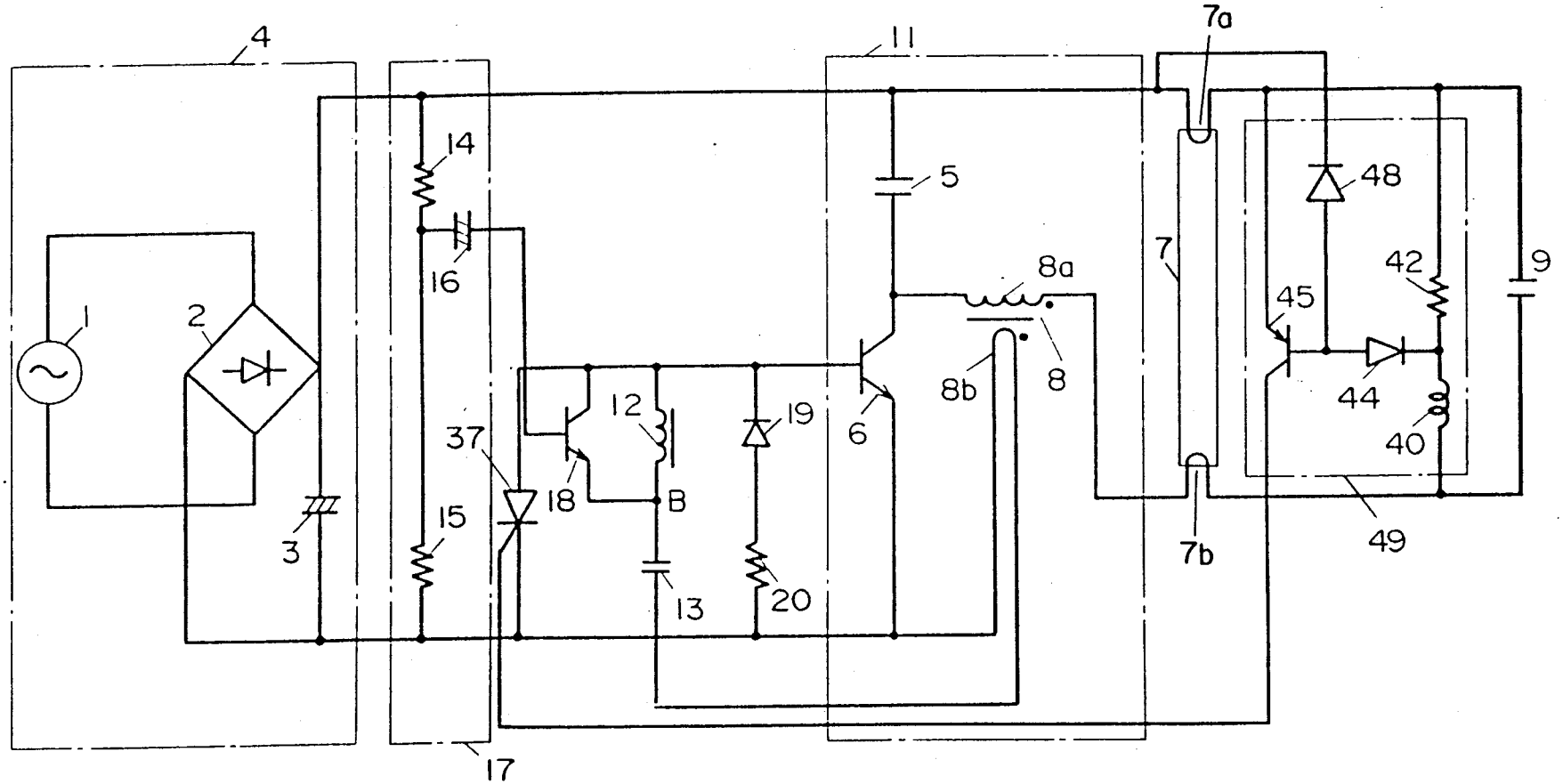

FIG. 6 is a circuit diagram showing a fourth embodiment of a discharge lamp apparatus of the present invention. In FIG. 6, the components from the commercial power source 1 to the resistor 20, and the control circuit composed of thyristor 37, inductor 40, resistor 42, diodes 48 and 44, and transistor 45 are the same as those in the second embodiment in both construction and operation. What is different is that the resistor 41 of the voltage detecting circuit 47 in the third embodiment show in FIG. 4 has been short-circuited.

In this constitution, in addition to the effects of the third embodiment, since the voltage is detected by the voltage due to only to the voltage drop of the filament electrode 7*a* instead of the voltage drop of the resistor 41, the voltage difference between the emitterless state of the lamp and its operating state may further enlarged, and the emitterless state may be detected more easily. In addition, the number of parts may be reduced.

Thus, according to these embodiments, the oscillation of the switching circuit may be stopped by detecting the lamp state in the voltage detecting circuit in a simple structure at the time of an abnormality of discharge lamp 7 or at the end of its service life. It is also possible to restart the lamp repeatedly, and use the lamp in high temperature environments. Moreover, since the detection level can be set without depending on the lamp voltage when operating, it can be applied to all lamps.

Incidentally, in the foregoing embodiments, the discharge lamp 7 was one of a preheat starting type, that is, a fluorescent lamp, but a high pressure discharge lamp may be similarly used, and the composition of the voltage detecting circuit is not particularly limited as long as it is possible to detect the current flowing in the inductor. As the switching circuit, moreover, the self-oscillation one-switching device resonance inverter was used, but an externally-oscillated type or multi-switching device type may be similarly employed to have same effects. In the control circuit, a thyristor was used, and other elements may be used as long as the oscillation of the transistor 6 can be stopped. Besides, similar effects can be obtained without using the timer circuit 17. It is the same when the inductors 10 and 40 of the voltage detecting circuit also serve as the inductors for the removal of DC components.

Figure 7:
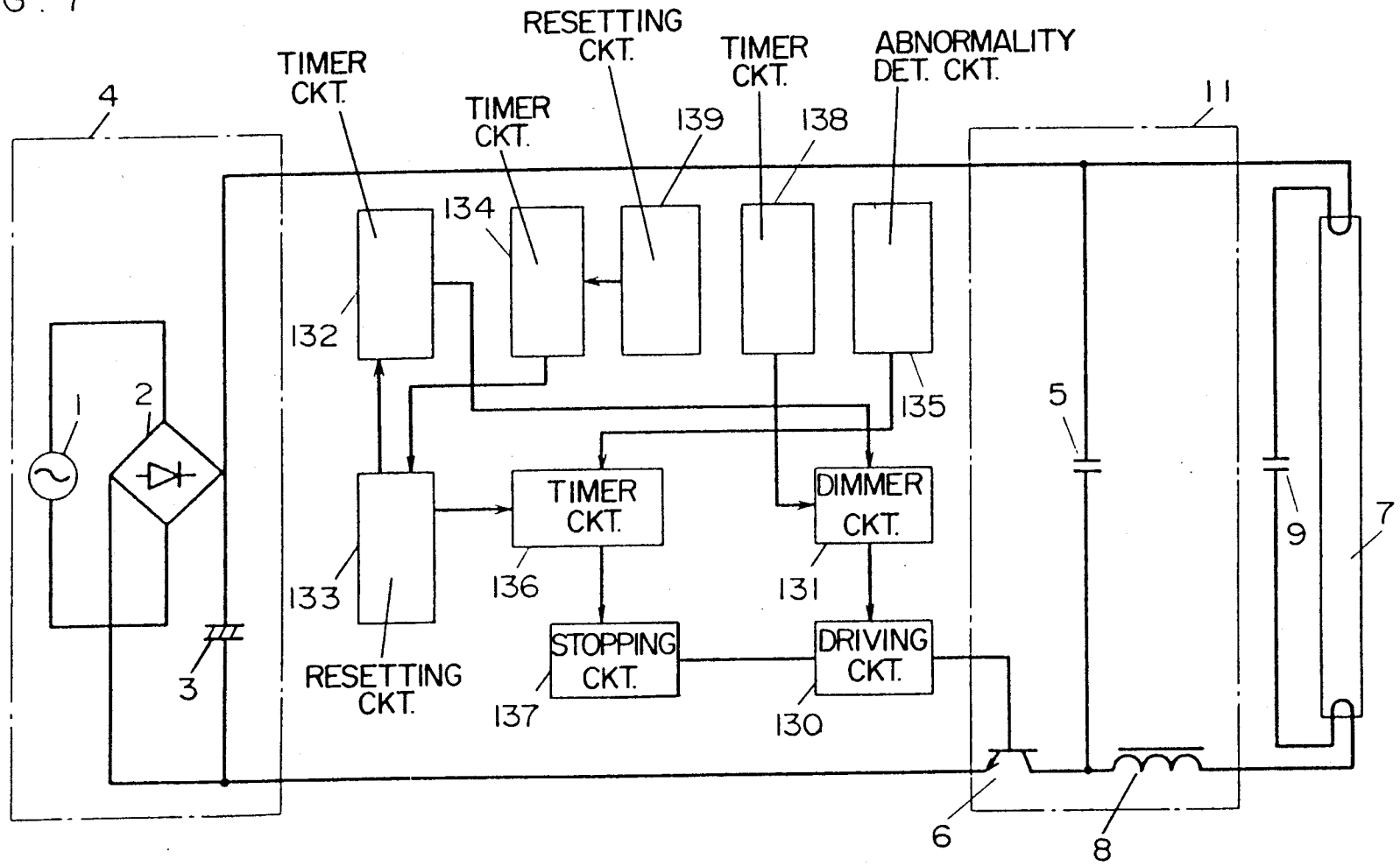
Figure 8A:
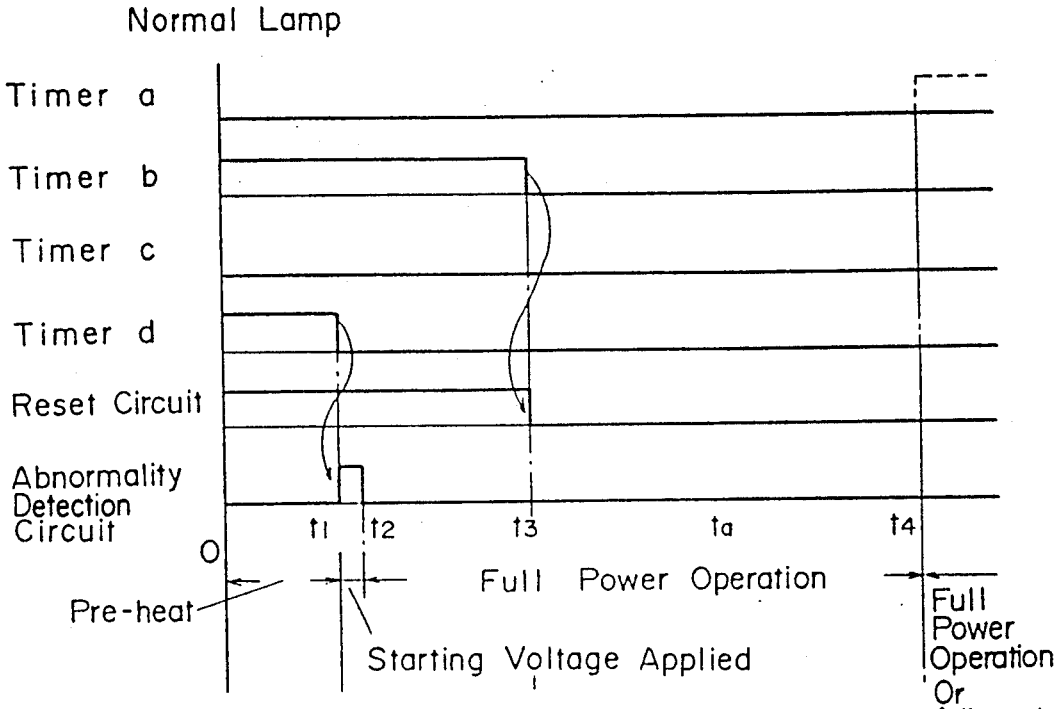
FIGS. 8(*a*)-8(*b*) show waveforms of the FIG. 7 circuit.
Figure 8B:
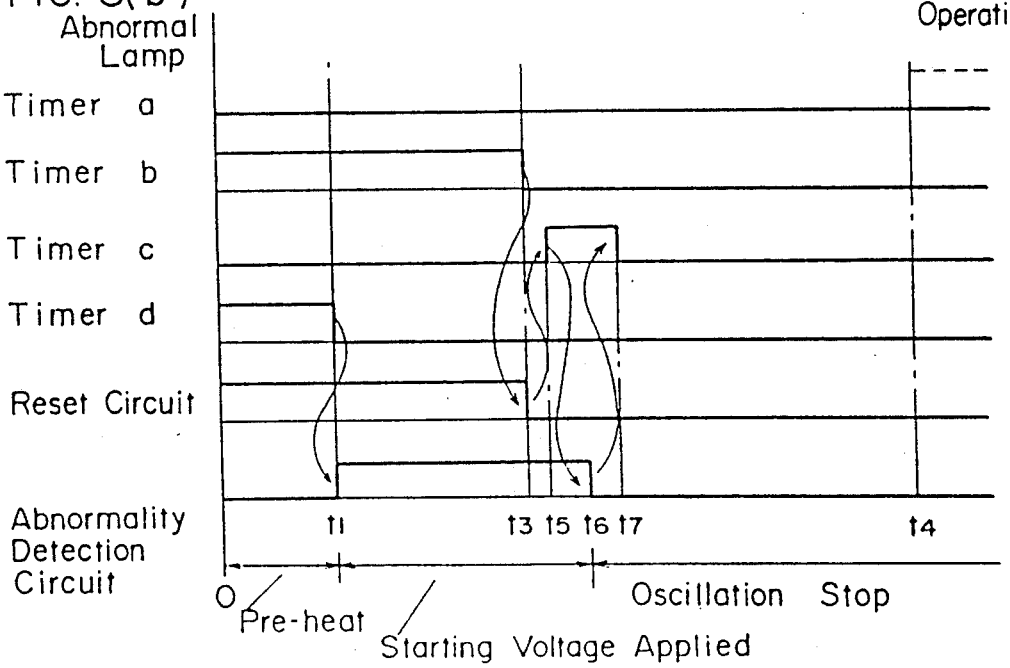
Figure 9:
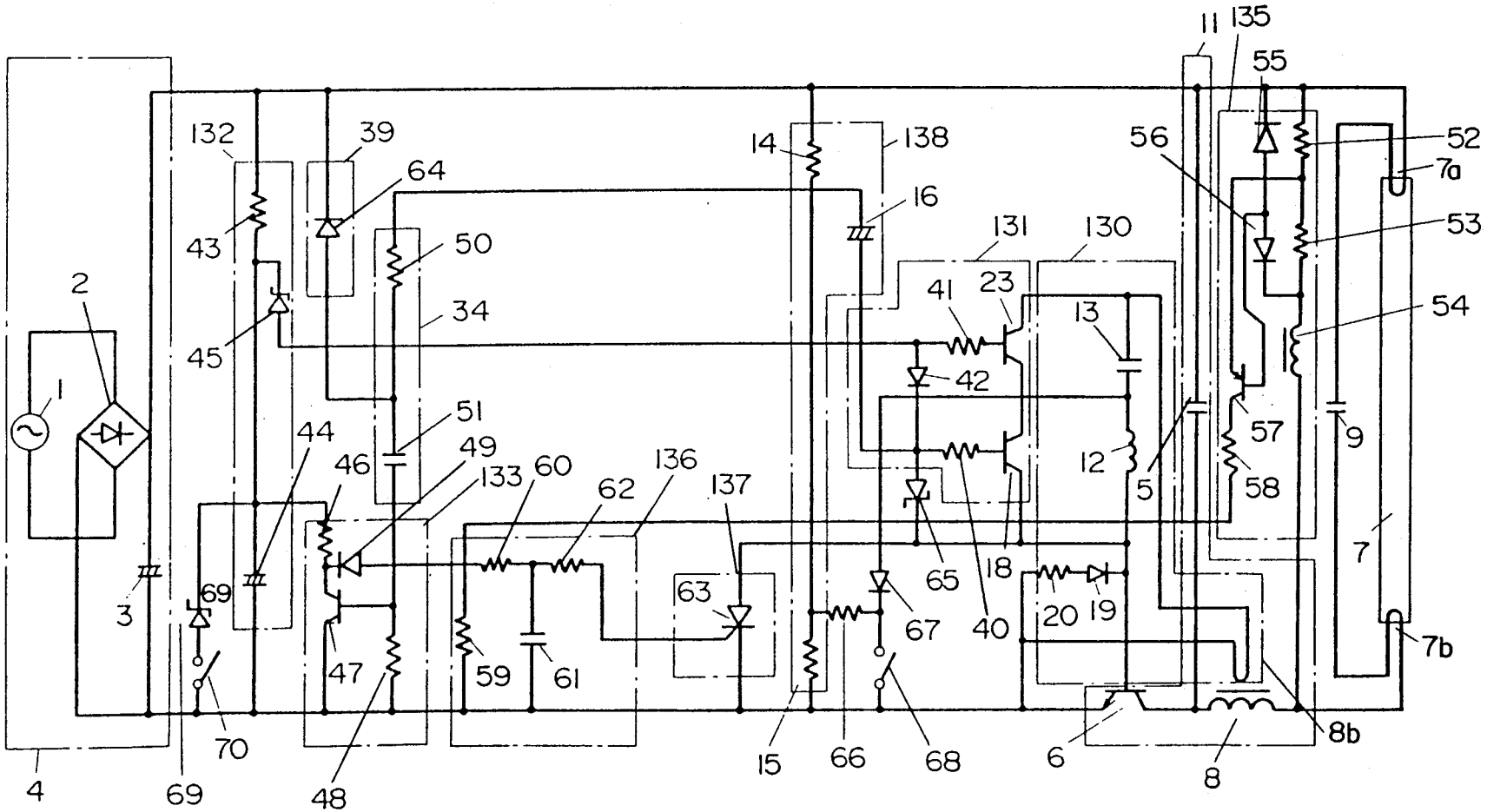
FIG. 9 is a circuit diagram of a sixth embodiment of a discharge lamp apparatus according to the present invention.

FIG. 7 is a block diagram of a circuit showing a fifth embodiment of a discharge lamp apparatus of the present invention. FIGS. 8(*a*)–8(*b*) are signal diagrams of each block of this embodiment of the discharge lamp apparatus of the present invention, and FIG. 9 is a circuit diagram of the discharge lamp apparatus of the embodiment. In FIG. 7 and FIG. 9, a power source 4, fluorescent lamp 7 as discharge lamp, capacitor 9, switching circuit 11, a timer circuit 138 composed of resistors 14 and 15 and capacitor 16 for forming a timer circuit d, and a driving circuit 130 composed of inductor 12, capacitor 13, diode 19, resistor 20, and secondary winding 8*b* are identical in construction and operation with the corresponding elements shown in FIG. 1.

Figure 2:
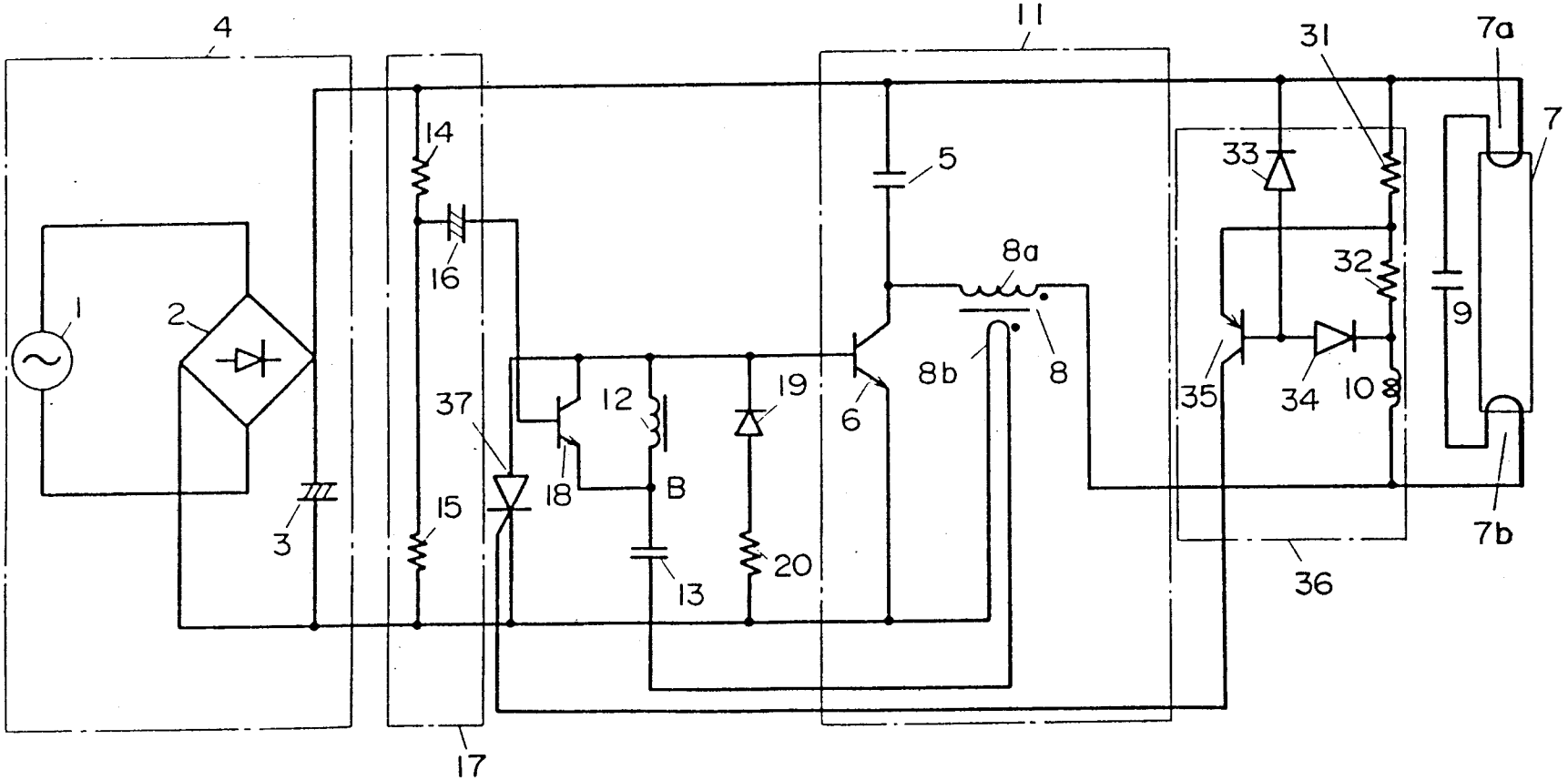
FIG. 2 is a circuit diagram of a first embodiment of a discharge lamp apparatus according to the present invention.
Figure 3A:
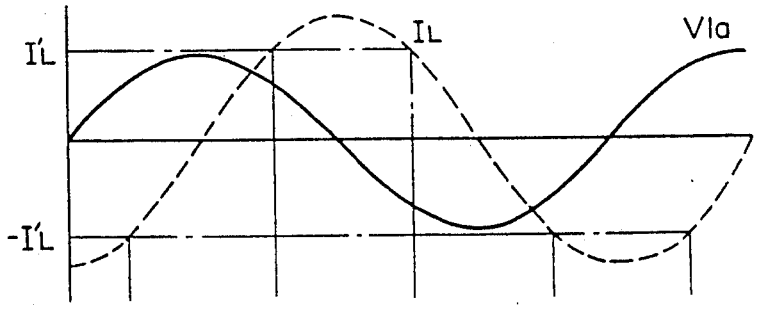
FIGS. 3(*a*)-3(*d*) show waveforms of the FIG. 2 circuit.
Figure 3B:
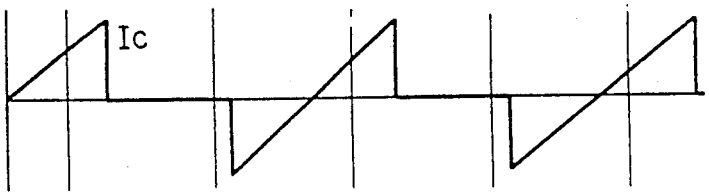
Figure 3C:
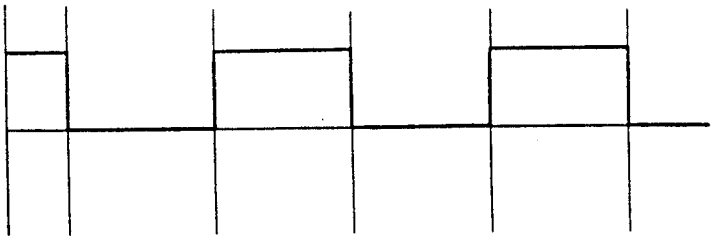
Figure 3D:
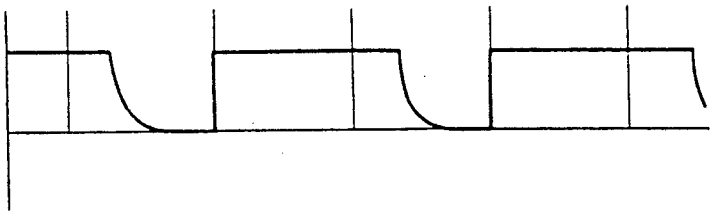

What are different from FIG. 1 are as follows: an abnormality detecting circuit 135 composed of resistors 52 and 53 and inductor 54 connected parallel to the fluorescent lamp 7 and having resistances connected to the side of the lamp 7 not connected to the transistor 6, diodes 55 and 56 having their cathodes connected to the ends of the series circuit of resistors 52 and 53, a transistor 57 having the anodes of the diodes 55 and 56 connected to the base thereof, and a resistor 58 connected to the collector of the transistor 57; a timer circuit 136 forming a timer circuit c and composed of a resistor 59 connected between the other end of the resistor 58 and the side of the power source connected to the transistor 6, a series circuit of a resistor 60 and capacitor 61 connected in parallel to the resistor 59, and a resistor 62 having one end connected to the connecting point of the series circuit; a stopping circuit 137 composed of a thyristor 63 connected so as to apply a short-circuit between the base and emitter of the transistor 6; a dimmer circuit 131 composed of a transistor 23 used as a control switch connected in parallel to the driving capacitor 13 and transistor 18 which is a control switch connected in parallel to the driving inductor 12, a resistor 41 connected to the base of the transistor 23, a resistor 40 connected to the base of the transistor 18, and a diode 42 having its anode connected to the other end of the resistor 41 and a cathode connected to the other end of the resistor 40; a timer circuit 132 with a specified time of ta and composed of an integration circuit having a capacitor 44 and a resistor 43 connected to the output side of the power source 4, and a zener diode 45 having its cathode connected to the connecting point of the integration circuit; a timer circuit 134 used as a timer circuit b with a specified time of tb, connecting a resistor 50 from the connecting point of the resistors 14 and 15 of the timer circuit 38, connecting a capacitor 51 to the other end of the resistor 50, and using the other end of the capacitor 51 as its output; a resetting circuit 133 composed of a series circuit of a resistor 46 and a transistor 47 connected in parallel to the capacitor circuit 44, a resistor 48 connected between the base and emitter of the transistor 47, and a diode 49 having its anode connected to a resistor 59 of the timer circuit 136 and having its cathode connected to the collector of the transistor 47, with the output of the timer circuit 134 being connected to the base of the transistor 47; a resetting circuit 139 composed of a diode 64 connected to the positive voltage end of the power source 4 from the middle point of the resistor 50 and capacitor 51 of the timer circuit 134; a series circuit of a zener diode 69 and a dimmer switch 70 connected in parallel to the capacitor 44, a zener diode 65 having its anode connected to the output end of the capacitor 16 and having its cathode connected to the base of the transistor 6, a series circuit of a diode 67 and a power switch 68 connected in the forward direction to the negative terminal of the power source 4 from the middle point of the capacitor 13 and the inductor 12 of the driving circuit 130, and a resistor 66 connected between the cathode of the diode 67 and the resistor 15.

The operation of the circuit of this embodiment composed in this way is explained below while referring to FIGS. 8(*a*)–8(*b*). The power switch 68 is initially set at its OFF position. While the fluorescent lamp 7 is normal, when the power source is turned on, a voltage is generated in the power source circuit 4, and the timer circuit 138 begins to operate, and a starting current flows through the resistor 40 of the dimmer circuit 131 and base of the transistor 18 by way of the resistor 14 and capacitor 16, and the transistor 18 and transistor 6 are turned on. Initially, the fluorescent lamp 7 is not lit, and the current behaves the same as in the prior art, and the ON state of the transistor 6 is maintained.

At this time, as shown in FIGS. 8(*a*)–8(*b*), the timer circuit 134 beings to operate same as does the timer circuit 138, and a signal current is supplied into the base of the transistor 47 of the resetting circuit 133 through the resistor 50 and capacitor 51. As a result, the transistor 47 is turned on, and the integration capacitor 44 of the timer circuit 132 is short-circuited through the resistor 46, and the timer circuit 132 maintains its reset state. At the same time, the input of the timer circuit 136 is short-circuited through the diode 49, and the abnormality detecting circuit 135 is made inoperative. Since the timer circuit 132 is not operating, the transistor 23 of the dimmer circuit 131 is in its OFF state. Therefore, the state of the driving circuit 130 is same as in the prior art, that is, only the transistor 18 which is in parallel to the inductor 12 is turned on, and the subsequent oscillation operation is also the same. Hence, the fluorescent lamp 7 is preheated, and by the above oscillation action and along with the passing of time, the temperature of the preheating electrode of the fluorescent lamp 7 goes up.

The timer circuit 134, incidentally, continues to supply base current to the transistor 47 while storing an electric charge in the capacitor 51 through the resistor 50 right after the power source is turned on. The timer circuit 138 also supplies the base current of the transistor 18 while storing an electric charge in the capacitor 16 through the resistor 14 since the energization, and after a specified time t1 in FIGS. 8(*a*)–8(*b*), when charged up to the voltage due to the resistors 14 and 15, it is no longer charged, and the transistor 18 is turned off. When the transistor 18 is turned off, the oscillation operation starts just as in the prior art, and a voltage larger than that of the preheating period before the stopping of the operation of the timer circuit 138 and sufficient for starting up the fluorescent lamp 7 is generated, and the fluorescent lamp 7 is started. When this starting voltage is applied, since the lamp voltage is large, a current flows, if the transistor 6 is ON, from the positive terminal of the power source to the transistor 6 by way of the resistances 52 and 53, inductor 54, and inductor 8. Accordingly, a voltage drop is generated in the resistors 52 and 53. Meanwhile, the voltage drop generated at this time is lower at the inductor 54 side and higher at the electrode 7*a* side of the lamp 7. By the voltage drop generated by the resistor 53 at this time, the diode 56 and transistor 57 are place in their ON state, and an output signal is delivered from the collector terminal of the transistor 57 through the resistor 58. At this time, too, however, since the resetting circuit 133 is operating, the signal is not delivered from the timer circuit 136 to the stopping circuit 137.

The operation of the circuit after starting is nearly the same as that after stopping of the operation of the timer circuit 138, but, as in the prior art, the lighting of the fluorescent lamp 7 is maintained by the on/off control of the transistor 6. The inductor 54 is also used for removal of the DC component of the current of the fluorescent lamp 7. Since the lamp voltage is small at this time, the transistor 57 of the abnormality detecting circuit 135 if OFF, and a signal is not delivered. The timer circuit 134 continues to deliver a signal in this period, and the capacitor 33 is charged. At the specified time t3 shown in FIGS. 8(*a*)–8(*b*), when the capacitor 33 is charged up to the dividing voltage of the resistors 14 and 15, the output of the timer 134 stops, and the transistor 47 of the resetting circuit 133 is turned off. When the operation of the resetting circuit 133 stops, the capacitor 44 of the timer circuit 132 begins to be charged.

When the dimmer switch 70 is ON, the capacitor 44 of the timer circuit 132 is charged from the power source 4 through the resistor 43, but since the zener voltage of the zener diode 69 is smaller than the zener voltage of the zener diode 45, the zener diode 45 is not made to conduct, and signal is not delivered from the timer circuit 132 to the dimmer circuit 131. Accordingly, thereafter, the fluorescent lamp maintains its full output.

When the dimmer switch 70 is OFF, after a specified time of ta, the voltage of the capacitor 44 reaches the zener voltage of the zener diode 69, and the zener diode 69 begins to conduct, and a signal current is delivered from the timer circuit 132 to the dimmer circuit 131. By this signal current, the transistor 23 conducts through the resistor 41, and the transistor 18 is also made to conduct by way of the diode 42 and resistor 40. When the transistors 23 and 18 conduct, the current flowing in the capacitor 13 and inductor 12 of the driving circuit 130 is branched off, and the resonance state is attenuated. Accordingly, substantially, the resonance frequency goes up, and the ON time of the transistor 6 is shortened, and the lamp current of the fluorescent lamp 7 decreases, and the fluorescent lamp 7 is dimmed.

If the electrode is in an emitterless state in an abnormality due to, for example, the end of life of the fluorescent lamp 7, when the power source 4 is turned on, the switching circuit 11 begins to oscillate as in the prior art. However, since the electrode of the fluorescent lamp 7 is emitterless, the lamp voltage becomes large, and as in the case of the application of the starting voltage, when the transistor 6 is ON, a current flows from the positive terminal of the power source into the transistor 6 by way of the resistors 52 and 53, inductor 54, and inductor 8. Therefore, a voltage drop is generated by the resistors 52 and 53. Meanwhile, the voltage drop generated at this time is lower at the inductor 54 side and higher at the electrode 7*a* side of the lamp 7. By the voltage drop taking place across the resistor 53 at this time, the diode 56 and transistor 57 are turned on, and an output signal is delivered at time t1 through the resistor 58 from the collector terminal of the transistor 57. At this time, since the resetting circuit 133 is turned on, the signal from the timer circuit 136 to the stopping circuit 137 is not delivered. At time t3, after the specified time tb of the timer circuit 134 has elapsed, the resetting circuit 133 stops its operation, and a voltage is generated in the resistor 59 of the timer circuit 136, so that the capacitor 61 is charged through the resistor 60. At time t5, when the voltage of the capacitor 61 reaches the gate turn-on voltage of the thyristor 63 of the stopping circuit 137, a signal current is delivered to the gate of the thyristor 63 of the stopping circuit 137 through the resistor 62. Accordingly, the thyristor 63 is turned on, and the base and emitter of the transistor 6 is short-circuited, and the transistor 6 is turned off, if energy is left over in the driving circuit or the like. After the transistor 6 is turned off, if energy is left over in the driving circuit or the like, the transistor 6 is about to turn on again, but since the output signal continues to be delivered for a specified time when the electric charge stored in the capacitor 61 from the timer circuit 136 is discharged through the resistor 62, the thyristor 63 is always in an ON state until time t7, so that the switching circuit 11 may be stopped by securely turning off (time t6) the transistor 6 until time t7.

In this operation, once the operation of the switching circuit is stopped, a starting current does not flow from the timer circuit 138 unless the timer circuit 138 is reset, and a restart is not effected. After stopping the operation of the resetting circuit 133, the timer 132 operates, but it does not matter at all.

In such a constitution, by properly setting the resistance value of the resistors 52 and 53, the detection level may be freely set. By using the abnormality detecting circuit 135 of such an electronic circuit composition, the magnitude of the lamp voltage at the time of operation does not matter, and the effect of the ambient temperature is eliminated because a temperature element such as a PTC thermistor is not used, so that the on/off switching may be repeated even in a location having a high ambient temperature. In the case of a normal lamp, since the resetting circuit 133 is operated during the specified time tb, it is started and operated and after the subsequent specified time ta, dimming is started, so that dimming may be stably maintained. In the event of an abnormality of the discharge lamp 7, it is possible to detect the abnormality regardless of the surrounding situations, and the oscillation of the switching circuit 11 can be stopped, and reliability, ease of use, and safety may be realized in a simple, inexpensive structure. In this embodiment, meanwhile, since the current of the timer circuit 134 is obtained from the power source 4 through the resistor 14 of the timer circuit 138, the capacitor 51 is discharged at the same timing as the discharge of the capacitor 16 when the power source 4 is turned off, and therefore, if the power source 4 is immediately turned on, the resetting circuit 133 can be securely put in operation when a starting current flows through the capacitor 16, so that failure in starting of fluorescent lamp 7 may be prevented.

The resetting circuit 139 is explained below. When the power source 4 is instantly turned on or off, or when the alternating current power source is momentarily stopped or the voltage is stopped momentarily, that is, when the fluorescent lamp 7 is once turned off and is about to light up immediately, the electric charges in the capacitors in the timer circuits 132, 134, 136, 138 are not discharged immediately. Accordingly, if attempted to start up, since the timers do not operate, the switching circuit 11 does not oscillate. Usually, however, there is a certain time delay from drop of the voltage of the power source 4 until the stop of discharge of the fluorescent lamp 7, and the capacitors are actually discharged slightly in this period. At this time, if a starting current flows through the capacitor 16, when the timer circuit 134 hardly operates, the resetting circuit 133 stops its operation immediately, and an output signal of the timer circuit 132 is generated, and the dimmer circuit operates from the beginning, and a lamp voltage necessary for starting cannot be generated, or if generated, the output from the abnormality detecting circuit 135 is transmitted to the stopping circuit 137 by way of the timer circuit 136, so that the stopping circuit 137 is actuated to stop the transistor 6. Accordingly, there was a problem of starting failure. To solve this problem, a simple structure of connecting the diode from the connecting point of the timer circuit 134 to the power source is employed. In this structure, if the voltage of the power source 4 drops even slightly, the electric charge in the capacitor 51 is discharged to the positive voltage output end of the power source 4 through the diode 64, so as to be ready for next starting. That is, even if the power source 4 is turned on right after this, the timer circuit 134 is actuated, and the resetting circuit 133 is put in action to inhibit the abnormality detecting circuit 135, while the timer circuit 132 is reset, so that the fluorescent lamp 7 is started.

The operation of the power switch 68 is as follows. The power switch 68 is initially in its OFF state, and no action takes place at this time. When the power switch 68 is turned on while the fluorescent lamp 7 is operating, the electric charge in the capacitor 16 is discharged from the resistor 66 and the emitter of the transistor 6 of the power switch 68 through its base and the zener diode 67. At the time, the resonance voltage of the driving circuit 130 is suppressed so as to be low through the diode 67 and the power switch 68. Accordingly, the transistor 6 is turned off, and the switching circuit 11 stops its oscillation. After once stopping, as long as the power switch 68 is in its ON state, the potential voltage of the resistors 14 and 15 are constant, and the voltage of the capacitor 16 remains constant, and the starting current does not flow, and the switching circuit 11 does not oscillate. When the power switch 68 is turned off, the potential voltage of the resistors 14 and 15 is raised, and the timer circuit 138 and timer circuit 134 are put in action, and the fluorescent lamp 7 can be started and operated after being preheated, so that darkening of the fluorescent lamp 7 may be reduced. Besides, since the fluorescent lamp 7 can be operated and extinguished by the switching circuit for a small signal in a simple structure of the power switch 68, a touch switch or other high function switch may be used.

Thus, according to the present invention, oscillation of the switching circuit may be stopped by an abnormality detecting circuit in a simple structure in the event of an abnormality or the end of life of the discharge lamp 7. It is also possible to start and restart the lamp repeatedly, and to use it in high temperature environments. Moreover, since the detecting level can be set regardless of the lamp voltage when operating, it can be applied to all lamps, and a normal lamp can be securely started and operated, or dimmed promptly, and a starting action is quick in the event of an instant restarting or momentary power failure.

In this embodiment, meanwhile, a fluorescent lamp is used for the discharge lamp 7, but a high pressure discharge lamp may be also used, and in this case the timer circuit 138 slows down the starting state of the switching circuit 11, and the stress on the circuit may be reduced. Incidentally, the basic effects will be obtained without the timer circuit 138. The composition of the abnormality detecting circuit 35, timer circuits 132, 134, 136, 138, stopping circuit 137, dimmer circuit 131, driving circuit 130, and sWitChing circuit 11 may be different from the description herein as long as the required functions are provided. That is, in this embodiment, the switching circuit 11 is of self-oscillation one-switching device resonance type inverter, but similar effects will be obtained in the externally oscillated type or multi-switching device type. The thyristor 63 is used in the stopping circuit 137, but other elements may be used as long as the oscillation of the transistor 6 can be stopped. The effect to stop the circuit is obtained without using the timer circuit 136. Besides, the same effect is obtained if the abnormality detecting circuit 135 is intended to detect the abnormality of the circuit, instead of the abnormality of the lamp. Also, as to the power switch 68, the existence of timer circuit 38 is sufficient and even if it is not a light control circuit, it can be used in a similar manner.

Figure 10:
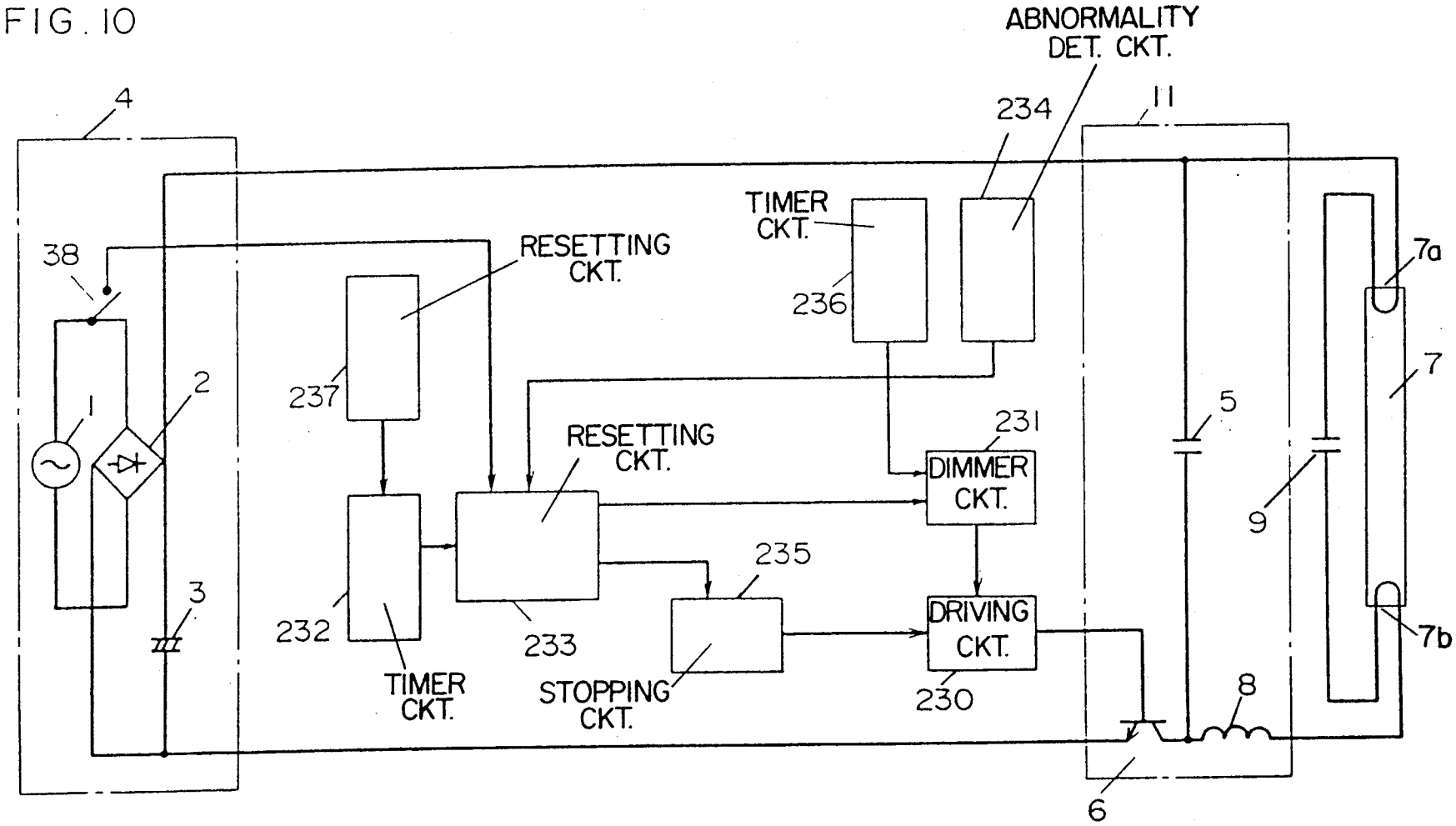
FIG. 10 is a circuit diagram of a seventh embodiment of a discharge lamp apparatus according to the present invention.
Figure 11A:
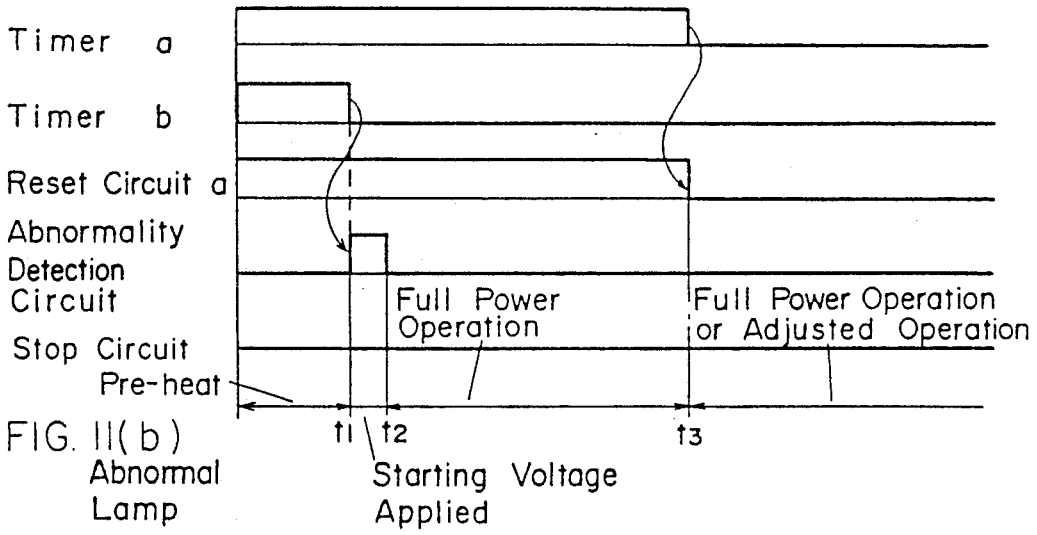
FIGS. 11(*a*)-11(*b*) show waveforms of the FIG. 10 circuit.
Figure 11B:
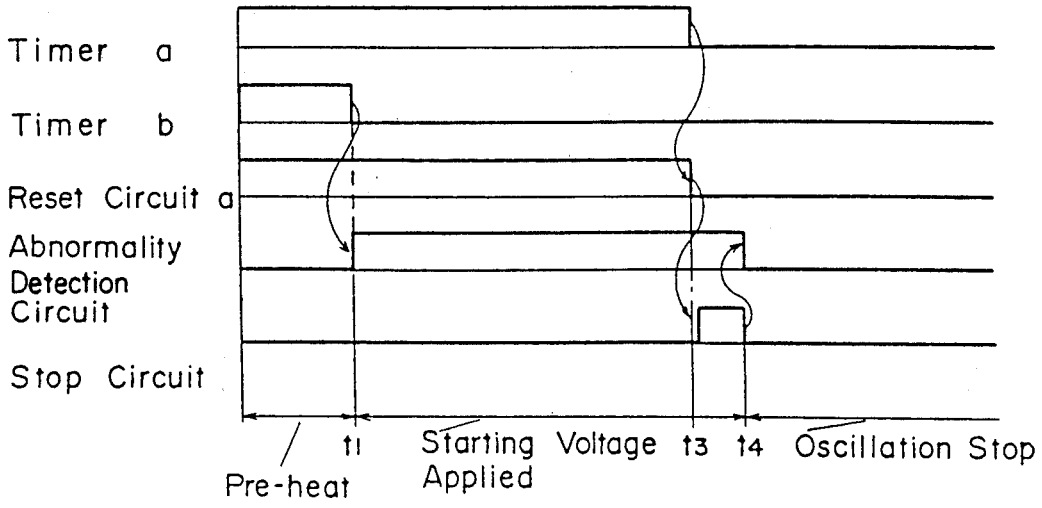
Figure 12:
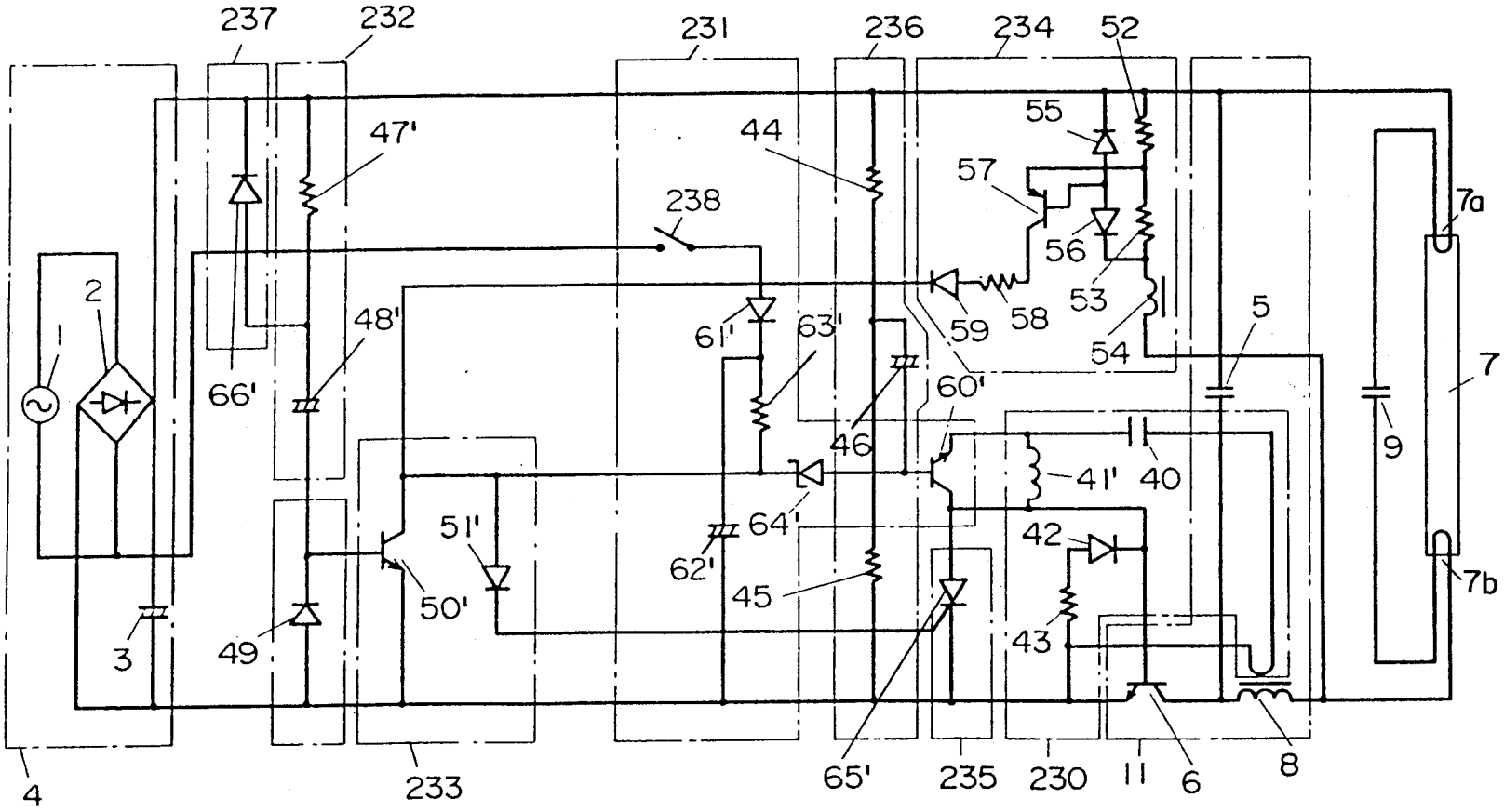
FIG. 12 is a circuit diagram of an eighth embodiment of a discharge lamp apparatus according to the present invention.

A sixth embodiment of the invention is described below while referring to the attached drawings. FIG. 10 is a block diagram showing a discharge lamp apparatus of the embodiment. Figs. 11(*a*)–11(*b*) are signal diagrams of each block of the embodiment of the discharge lamp operation apparatus of the present invention, and FIG. 12 is a circuit diagram of the discharge lamp apparatus of the embodiment. In FIGS. 10 and 12, a power source 4, fluorescent lamp 7 used as a discharge lamp, capacitor 9, switching circuit 11, the timer circuit 236 used as timer circuit b and composed of resistors 44 and 45, and capacitor 46, and the driving circuit 230 composed of inductor 41', capacitor 40, diode 42, resistor 43, and secondary winding 8*b* are same as those in the example in FIG. 1 in construction and operation. The resistors 44 and 45, capacitor 46, inductor 41, capacitor 40, diode 42, and resistor 43 in FIG. 12 are identical with the resistors 14 and 15, capacitor 16, inductor 12, capacitor 13, diode 19, and resistor 20 in FIG. 4, respectively.

What are different from FIG. 1 are as follows: an abnormality detecting circuit 234 composed of resistors 52 and 53 connected in series with an inductor 54 and the series combination connected parallel to the fluorescent lamp 7 and having the resistors connected to the side of the lamp 7 not connected to the transistor 6, diodes 55 and 56 having their cathodes connected across the series circuit of resistors 52 and 53, a transistor 57 having its emitter connected to the middle point of the series circuit of resistors 52 and 53 and having the anodes of the diodes 55 and 56 connected to the base thereof, a resistor 58 connected to the collector of the transistor 57, and a diode 59 having its anode connected to the other end of the resistor 58; a resetting circuit 233 forming a reset circuit a and composed of a transistor 50 having its collector and emitter connected between the cathode of the diode 59 and the transistor 6 side end of the power source 4; a diode 49 connected in the reverse direction between the base and the emitter of the transistor 50', and a diode 51' having the anode connected to the collector of the transistor 50'; a stopping circuit 235 composed of a thyristor 65' connecting so as to apply a short-circuit between the base and emitter of the transistor 6 and having its gate connected to the cathode of the diode 51'; a dimmer circuit 231 composed of a series circuit of a transistor 60' used as another switch with control terminal connected in parallel to the driving inductor 41, a zener diode 64' having its anode connected to the base of the transistor 60', a resistor 63' connected to the cathode of the zener diode 64', a capacitor 62' connected between the other end of the resistor 63' and the transistor 6 side of the power source 4, a switch 238 connected between the other end of the resistor 63' and one end of the alternating current power source 1, and the diode 61'; a timer circuit 232 used as a timer circuit a of specified time of t3 and composed of a series circuit of a resistor 47' and a capacitor 48' connected between the lamp side output end of the power source 4 and the base of the transistor 50'; and a resetting circuit 237 used as a resetting circuit b and composed of a diode 66' having its cathode connected to the middle point of the series circuit of the timer circuit 232, and having its cathode connected to the lamp side end of the power source 4.

The operation of the circuit of this embodiment composed in this manner is explained below while referring to FIGS. 11(*a*)–11(*b*). The switch 238 is initially in its OFF state. When the fluorescent lamp 7 is normal, by turning on the power source, a voltage is generated in the power source circuit 4, and the timer circuit 236 begins to operate, and a starting current flows through the resistor 44 and capacitor 46, and also the base of the transistor 60 of the dimmer circuit 31, thereby causing the transistor 60' and the transistor 6 to conduct. Initially, the fluorescent lamp 7 is not lit, and the current behaves as in the prior art, and the ON state of the transistor 6 is maintained.

At this time, as shown in FIGS. 11(*a*)-11(*b*), the timer circuit 232 begins to operate as the timer circuit 236, and a signal current is supplied into the base of the transistor 50' of the resetting circuit 233 through the resistor 47' and capacitor 48' Accordingly, the transistor 50' is turned on, and the resetting circuit 233 maintains the reset state. Therefore, the abnormality detecting circuit 234 is inhibited. Regardless of the switch 38, the dimmer circuit 231 is also inhibited by the resetting circuit 233. Hence, the state of the driving circuit 230 is as in the conventional example, that is, only the transistor 60' in parallel to the inductor 41' is turned on, and the subsequent oscillation is also the same. The fluorescent lamp 7 is preheated, and along with the passing of the time by the oscillation noted above, the temperature of the preheat electrode of the fluorescent lamp 7 goes up.

The timer circuit 232 continues to supply the base current to the transistor 50' while storing an electric charge in the capacitor 48' through the resistor 47' after the power source is turned on. Also the time circuit 236, after the power source is turned on, supplies the base current of the transistor 60' while storing an electric charge in the capacitor 46 until it is charged up to the voltage due to the resistors 44 and 45 after a specified time t1 as shown in FIGS. 11(*a*)-11(*b*), and is no longer charged, and the transistor 60' is turned off. When the transistor 60' is turned off, the oscillation is effected as in FIG. 1, and a voltage larger than that of preheating before the stopping of the operation of the timer circuit 236 and sufficient for starting the fluorescent lamp 7 is generated, so that the fluorescent lamp 7 is started. Incidentally, when this starting voltage is applied, since the lamp voltage is large, at the time the transistor 6 is turned on, a current flows from the positive terminal of the power source to the transistor 6 by way of the resistors 52 and 53, inductor 54, and inductor 8, so that a voltage drop is generated by the resistors 52 and 53. The voltage potential at this time is lower at the inductor 54 side and higher at the electrode 7*a* side of the lamp 7. By the voltage drop generated by the resistor 53, the diode 56 and the transistor 57 are placed in their ON state, and an output signal is delivered from the collector terminal of the transistor 57 through the resistor 58. At this time, too, since the resetting circuit 233 is operating, no signal is delivered from the resetting circuit 233 to the stopping circuit 237.

The operation of the circuit after starting is nearly the same as that after stopping of the action of the timer circuit 236, and similar to the prior art; the fluorescent lamp 7 is maintained in its operating state by the on/off control of the transistor 6. Meanwhile, the inductor 54 is also used for removal of the DC components of the current of the fluorescent lamp 7. At this time, since the lamp voltage is small, the transistor 57 of the abnormality detecting circuit 34 is OFF, and no signal is delivered. The timer circuit 232 is delivering an output even in the above period, and the capacitor 48 is charged. At specified time t3 as shown in FIGS. 11(*a*)-11(*b*), when the capacitor 48' is charged up nearly to the output voltage of the power source 4, the output of the timer circuit 232 ceases, and the transistor 50' of the resetting circuit 233 is turned off.

When the switch 238 is OFF, the capacitor 62' of the dimmer circuit 231 is not changed from the alternating current power source 1 through the diode 61', and no current flows from the resistor 63' and zener diode 64' to the transistor 60'. Hence, thereafter, the fluorescent lamp 7 is maintained in its full output state.

When the switch 238 is ON, by turning on the power source, the AC voltage of the alternating current power source 1 is subjected to half-wave rectification by the diode 61' and capacitor 62' by way of the switch 238, and the rectified voltage is applied to the base of the transistor 60' through the resistor 63' and zener diode 64'. Before specified time t3, since the resetting circuit 233 is operating, the current flowing through the resistor 63' flows into the transistor 50' and does not flow into the transistor 60'. Accordingly, the fluorescent lamp 7 is in its full output state. After the specified time t3, the transistor 50' of the resetting circuit 233 is turned off, and the voltage is applied to the base of the transistor 60' from the capacitor 62' through the resistor 63' and zener diode 64. As a result, the transistor 60' turns on. When the transistor 60' turns on, the current flowing in the inductance 41' of the driving circuit 230 is branched off, and the resonance state dwindles. Substantially, therefore, the resonance frequency goes up, and the ON time of the transistor 6 is shortened, and the lamp current of the fluorescent lamp 7 decreases, so that the fluorescent lamp 7 is dimmed.

When the electrode is in an emitterless state due to abnormality such as the end of life of the fluorescent lamp 7, by turning on the power source, the switching circuit 11 begins to operate as in the prior art. However, since the electrode of the fluorescent lamp 7 is emitterless, the lamp voltage increases, and as when the starting voltage is applied, in the ON state of the transistor 6, a current flows from the positive terminal of the power source through the resistors 52 and 53, inductor 54, inductor 8, and into the transistor 6. Accordingly, a voltage drop occurs in the resistors 52 and 53. The voltage potential at this time is lower at the inductor 54 side and higher at the electrode 7*a* side of the lamp 7. By this voltage drop taking place across the resistor 53, the diode 56 and transistor 57 are place in their ON state, and an output signal is delivered from the collector terminal of the transistor 57 through the resistor 58 at time t1. At this time, since the resetting circuit 233 is turned on, a signal is not delivered to the stopping circuit 237. After the resetting circuit 233 has operated over the specified time t3 of the timer circuit 232, the resetting circuit 233 stops its action, and therefore the current is delivered from the abnormality detecting circuit 234 to the gate of the thyristor 65' of the stopping circuit 235. Accordingly, the thyristor 65' is turned on, and the base and emitter of the transistor 6 are short-circuited. At the same time, the output current of the abnormality detecting circuit 234 flows into the base of the transistor 60' through the resetting circuit 233 and zener diode 64'. Therefore, the oscillation of the switching circuit 11 is similar to the dimmed state, and is attenuated. As a result, the transistor 6 is likely to be turned off, and it is securely turned off at time t4, so that the switching circuit 11 is stopped.

In this operation, when the switching circuit 11 is once stopped, the starting current does not flow from the timer circuit 236 unless the timer circuit 236 is reset, and it is not restarted.

When the alternating current power source 1 is turned off, the capacitor 48' of the timer circuit 232 is immediately discharged through the diodes 66' and 49 of the resetting circuit 237. Simultaneously, the capacitor 46 of the timer circuit 236 is immediately discharged through the resistors 44 and 45 and transistor 60'. Accordingly, when the alternating current power source 1 is turned on next time, the timer circuits 232 and 236 are put in action, and whenever a starting current flows through the capacitor 46, the resetting circuit 233 is actuated, so that a starting failure of the fluorescent lamp 7 may be prevented, and the life of the fluorescent lamp can be extended. Accordingly, the event of, for example, a momentary power failure of the alternating current power source is a safe event.

In this constitution, by properly setting the resistance values of the resistors 52 and 53, the detection level can be set freely, and by using the abnormality detecting circuit 235 in such an electronic circuit composition, it is possible to turn the lamp on and off repeatedly, regardless of the magnitude of the lamp voltage when operating, or even at a location having a high ambient temperature because a temperature element such as a PTC thermistor is not used. Besides, in the case of a normal lamp, since the resetting circuit 233 is operated for a specified time t3, starting and operating are secure, and the operation may be stably transferred to a dimming state, which can be also maintained securely. In the event of an abnormality of the discharge lamp 7, it is possible to detect same regardless of the ambient conditions, and the oscillation of the switching circuit 11 my be securely stopped, so that reliability, ease of use, and safety are realized in a simple and inexpensive structure.

In this embodiment, too, the transistor 60' of the dimmer circuit 131 is connected parallel to the inductor 41' of the driving circuit 230, and the emitter is connected to the capacitor 40. When dimming or preheating, at the time of turning-on of the transistor 6, if the electric charge in the capacitor 40 flows into the base of the transistor 6 without passing through the inductor 41' by way of the transistor 60', the transistor 6 may be forced to be turned on while there is still a remaining voltage between the collector and emitter of the transistor 6 by oscillation of the capacitor 5 and inductor 8 of the switching circuit 11, and as a result the turn-on loss of the transistor 6 may be raised. According to the composition of this embodiment, at the time of turning-on of the transistor 6, the flow of the electric charge in the capacitor 40 into the base of the transistor 6 without passing through the inductor 41' by way of the transistor 60' is decreased, and it is passed through the inductor 41', and the turn-on timing is delayed so as to turn on only after the voltage between the collector and emitter of the transistor 6 has been lowered, thereby notably decreasing the turn-on loss of the transistor 6.

Furthermore, by connecting a diode in forward direction in series to the collector of the transistor 60', the current flowing in the forward direction into the collector from the base of the transistor 60' may be shut off, and the current flowing from the emitter to the collector may be also cut off, and therefore the turn-on timing of the transistor can be perfectly made adequate, so that the loss can be reduced.

Thus, according to the foregoing embodiments, the oscillation of the switching circuit can be securely stopped by the abnormality detecting circuit 234 in a simple structure in the event of an abnormality of the discharge lamp 7 or at the end of its life. It is also possible to restart the lamp repeatedly and use the lamp in high temperature environments. In addition, the detection level can be set regardless of the lamp operating voltage, so that it may be applied to all lamps. The normal lamp can be securely started, operated and dimmed by smooth transfer of actions, and starting is instant even when immediately restarting the lamp or after a momentary power failure.

Moreover, by feeding the output current of the abnormality detection circuit 234 to the dimmer circuit, the stopping of oscillation in the event of an abnormality can be effected promptly and securely.

What is more, since the input to the dimmer circuit 231 is obtained directly from the alternating current power source 1 by half-wave rectification without resort to the output of the power source circuit 4, the dimming level can be set independently of other circuits, and the supply voltage fluctuation characteristics in dimming can be set independently. That is, the secondary winding voltage of the inductor 8 is proportional to the balance of the output voltage of the power source 4 minus the lamp voltage, and is also proportional to the supply voltage, and this voltage is proportional to the lamp output. On the other hand, the dimming input is proportional to the voltage of the alternating current power source 1, and it is therefore inversely proportional to the oscillation state of the driving circuit, and it is also inversely proportional to the lamp output. Accordingly, the dimming input and secondary winding voltage of the impedance 8 are in reverse relation in pair against the lamp output, and they compensate for each other with respect to the supply voltage fluctuations. Hence, by designing to make it possible to set the dimming input voltage independently, the supply voltage fluctuation characteristic can be freely set. Moreover, a dimming/full light switch 238 can be provided in the alternating current power source 1, and the dimming can be changed over in the power switch unit, so that operation may be facilitated.

In the embodiments of the invention, still more, dimming may be realized in a simple structure of merely connecting the transistor 60' in parallel to the inductor 41'. Furthermore, the transistor 60' of the dimmer circuit 231 can be used for preheating. In addition, by connecting the transistor 60' so that the emitter may be connected to the capacitor 40' side, the loss of the transistor 6 may be notably decreased. Furthermore, by connecting the diode in series with the collector of the transistor 60', the loss may be further decreased.

In the foregoing embodiment, a fluorescent lamp was used for the discharge lamp 7, but a high pressure discharge lamp may be similarly used. The structures of the abnormality detecting circuit 234, timer circuits 232 and 236, stopping circuit 235, dimmer circuit 231, driving circuit 230, switching circuit 11, and resetting circuits 233 and 237 are not particularly limited as far as the specified functions are provided. For example, instead of the self-oscillation one-switching resonance type device inverter used for the switching circuit 11, an externally oscillated type, multi-switching device, or others may be similarly employed. For the stopping circuit 237, the thyristor 63 was used, but others may be used as long as it is possible to stop the oscillation of the transistor 6. Or the same effect will be obtained if the abnormality detecting circuit 234 is designed to detect the abnormality of the circuit, instead of the abnormality of the lamp. As the transistors 6, 50', 57, and 60', FETs and other devices may also be used.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the present invention.

We claim:

1. A discharge lamp operation apparatus comprising:

a power source having a predetermined polarity of output voltage;

a switching circuit connected to an output of said power source, possessing at least one switch with control terminal, inductor, and capacitor, said switching circuit designed to start and operate a discharge lamp connected to said output by turning said power source on and off and to control an electric current of the discharge lamp in the forward direction by means of said at least one switch;

a driving circuit connected to said at least one switch;

a voltage detecting circuit having at least one inductor connected in parallel to the discharge lamp, and designed to detect the lamp voltage of the discharge lamp by detecting the current flowing in the inductor, and a control circuit for receiving an output signal from said voltage detecting circuit and for delivering a signal to said driving circuit so as to turn off said switch.

2. A discharge lamp operation apparatus as recited in claim 1, wherein said voltage detecting circuit detects the lamp voltage of the discharge lamp by detecting the flow of current in the positive and negative direction flowing in the inductor connected in parallel to the discharge lamp.

3. A discharge lamp operation apparatus as recited in claim 2, wherein the voltage detecting circuit comprises a series circuit of said inductor and two resistors connected in parallel to the power source side of the discharge lamp and two diodes having one terminal respectively connected to both terminals of the two resistors connected in series, and a three-terminal control element having one terminal connected to the connecting point of the resistors connected in series and the other terminal of the two diodes connected to a control terminal of said control element, and having another terminal of said three-terminal control element used as an output thereof.

4. A discharge lamp operation apparatus as recited in claim 3, wherein the discharge lamp is a preheat starting type lamp, and said voltage detecting circuit is connected in parallel to the side of the lamp other than the side connected to the power source.

5. A discharge lamp operation apparatus as recited in claim 4, wherein the cathode terminal of one of said two diodes connected is connected to a side of the discharge lamp connected to said power source.

6. A discharge lamp operation apparatus as recited in claim 5, wherein the resistance between said diode connected to said side of the discharge lamp connected to said power source and one terminal of said three-terminal control elements consists of a preheating electrode of the discharge lamp.

7. A discharge lamp operation apparatus comprising:

a power source having a predetermined polarity of output voltage;

a switching circuit connected to an output of said power source, possessing at least one switch with control terminal, inductor and capacitor, said switching circuit designed to start and operate a discharge lamp connected to said output by turning said power source on and off and to control an electric current of the discharge lamp in the forward direction by means of said at least one switch;

a driving circuit connected to said at least one switch;

an abnormality detecting circuit for sensing an abnormality in a voltage of the discharge lamp and for delivering an output signal in response thereto;

a stopping circuit for receiving said output signal from said abnormality detecting circuit and for delivering a signal to said driving circuit to turn off said at least one switch;

a dimmer circuit connected to said driving circuit for controlling said driving circuit and for dimming the discharge lamp;

a timer circuit a for delivering a signal to said dimmer circuit after a specified time period has elapsed;

a timer circuit b for delivering a signal during another specified time period within said specified time period of said timer circuit a, and a resetting circuit a for resetting said timer circuit a in accordance with said signal from said timer circuit b, and for disabling said abnormality detecting circuit in response thereto.

8. A discharge lamp operation apparatus as recited in claim 7, which further comprises a resetting circuit b for resetting said timer circuit b in accordance with the on/off state of said power source.

9. A discharge lamp operation apparatus as recited in claim 8, which further comprises a timer circuit c connected to said abnormality detecting circuit, stopping circuit, and resetting circuit a, so as to deliver an output signal during a specified time period depending on said signal from said abnormality detecting circuit to said stopping circuit, and so as to also disable said abnormality detecting circuit in accordance with said signal from said resetting circuit a.

10. A discharge lamp operation apparatus as recited in claim 9, which further comprises a timer circuit d for lowering the output to the lamp for a specified time period by delivering a signal during a specified time period which is shorter than said specified time period of said timer circuit b to said dimmer circuit.

11. A discharge lamp operation apparatus comprising:

a power source having a predetermined polarity of output voltage;

a switching circuit connected to an output of said power source, possessing at least one switch with control terminal, inductor and capacitor, said switching circuit designed to start and operate a discharge lamp connected to said output by turning said power source on and off and to control an electric current of the discharge lamp in the forward direction by means of said at least one switch;

a driving circuit connected to said at least one switch, possessing a driving inductor and a driving capacitor, and making use of the resonance of said driving capacitor and driving inductor;

a control switch element connected in parallel to said driving inductor;

a timer circuit composed of a series circuit of another capacitor and a resistor a having one terminal connected to said power source, for delivering a signal from another terminal of said another capacitor to said control terminal of said control switch element;

a constant voltage diode having an anode connected to an output side of said another capacitor and having a cathode connected to said control terminal of said at least one switch;

a resistor b having one terminal connected to a connecting point of said series circuit of said timer circuit;

a diode connected from a connecting point between said driving inductor and driving capacitor to another terminal of said resistor b, and a power switch connected between one side of said power source and a connecting point between said resistor b and said diode.

12. A discharge lamp operation apparatus as recited in claim 11, further comprising a dimmer circuit provided with a control switch element connected in parallel to said driving inductor, and a timer circuit d comprising a series circuit of an additional capacitor and a resistor having one terminal connected to said power source so as to deliver a signal from another terminal of said additional capacitor to said control terminal of said control switch element.

13. A discharge lamp operation apparatus comprising:

a power source having a predetermined polarity of output voltage;

a switching circuit connected to an output of said power source, possessing at least one switch with control terminal, inductor and capacitor, said switching circuit designed to start and operate a discharge lamp connected to said output by turning said power source on and off and to control an electric current of the discharge lamp in the forward direction by means of said at least one switch;

a driving circuit connected to said at least one switch;

an abnormality detecting circuit for detecting an abnormality in a voltage of the discharge lamp an for delivering an output signal in response thereto;

a stopping circuit for receiving said output signal of said abnormality detecting circuit and for delivering a signal to said driving circuit to turn off said at least one switch;

a dimmer circuit connected to the driving circuit for controlling said driving circuit and for dimming the discharge lamp;

a timer circuit a for delivering a signal during a specified time period, and a resetting circuit a for disabling said dimmer circuit and said abnormality detecting circuit in response to said signal from said timer circuit a.

14. A discharge lamp operation apparatus as recited in claim 13, further comprising a resetting circuit b for resetting said timer circuit a in accordance with the on/off state of said power source.

15. A discharge lamp operation apparatus as recited in clam 14, wherein said output signal of said abnormality detecting circuit is fed to said dimmer circuit by way of said resetting circuit a.

16. A discharge lamp operation apparatus as recited in claim 15, wherein said power source comprises a means for rectifying an output from an alternating current power source, and a series circuit of a rectifying element and a capacitor connected from one terminal of said alternating current power source to one of said at least one switch, and wherein a voltage of said capacitor is inputted to said dimmer circuit through a resistance.

17. A discharge lamp operation apparatus comprising:

a power source having a predetermined polarity of output voltage;

a switching circuit connected to an output of said power source, possessing at least one switch with control terminal, inductor and capacitor, said switching circuit designed to start and operate a discharge lamp connected to said output by turning said power source on and off and to control an electric current of the discharge lamp in the forward direction by means of said switch;

a driving circuit connected to said at least switch and comprising a driving inductor and driving capacitor and making use of the resonance of said driving capacitor and driving inductor, and a dimmer circuit comprising at least another switch with control terminal connected in parallel to said driving inductor for controlling said driving circuit and for controlling the discharge lamp.

18. A discharge lamp operation apparatus as recited in claim 17, wherein the discharge lamp is a preheat starting type discharge lamp, and further comprising a timer circuit b for delivering a signal to said dimmer circuit during a specified period of time.

19. A discharge lamp operation apparatus as recited in claim 18, wherein said at least another switch with control terminal comprises a transistor which is connected so that the current may flow into a connecting point of said driving inductor and driving capacitor.

20. A discharge lamp operation apparatus as recited in claim 19, wherein a diode is connected so that current may flow into said connecting point of said driving inductor and driving capacitor and is disposed between said at least one switch with control terminal and said at least another switch with control terminal.

* * * * *